US008231192B2

(12) United States Patent
Aoki et al.

(10) Patent No.: US 8,231,192 B2
(45) Date of Patent: Jul. 31, 2012

(54) LIQUID DETECTION UNIT, AND LIQUID CONTAINER USING LIQUID DETECTION UNIT

(75) Inventors: Yuji Aoki, Matsumoto (JP); Hitotoshi Kimura, Matsumoto (JP)

(73) Assignee: Seiko Epson Corporation, Toyko (JP)

( * ) Notice: Subject to any disclaimer, the term of this patent is extended or adjusted under 35 U.S.C. 154(b) by 1037 days.

(21) Appl. No.: 12/102,451

(22) Filed: Apr. 14, 2008

(65) Prior Publication Data

US 2008/0252669 A1 Oct. 16, 2008

(30) Foreign Application Priority Data

Apr. 13, 2007 (JP) ..... 2007-105922
Sep. 12, 2007 (JP) ..... 2007-236140

(51) Int. Cl.
*B41J 2/195* (2006.01)

(52) U.S. Cl. ..... 347/7; 137/558

(58) Field of Classification Search ..... 347/7; 439/525, 439/775, 789; 137/558
See application file for complete search history.

(56) References Cited

U.S. PATENT DOCUMENTS 3,106,435 A * 10/1963 Yopp ..... 439/525
3,445,022 A * 5/1969 Cilluffo ..... 215/216
4,050,755 A * 9/1977 Hasircoglu ..... 439/71
4,245,878 A * 1/1981 Hall ..... 439/332
4,359,276 A * 11/1982 Tomori ..... 396/80
4,645,289 A * 2/1987 Isban ..... 439/101
5,139,427 A * 8/1992 Boyd et al. ..... 439/66
5,644,093 A * 7/1997 Wright et al. ..... 73/866.5
5,755,136 A * 5/1998 Getman et al. ..... 73/290 V
6,183,267 B1 * 2/2001 Marcus et al. ..... 439/66
6,199,575 B1 * 3/2001 Widner ..... 137/227
6,223,769 B1 * 5/2001 Bragg et al. ..... 137/557
6,860,766 B2 * 3/2005 Aujla et al. ..... 439/733.1
7,341,097 B2 * 3/2008 Darby ..... 165/11.1
7,575,439 B2 * 8/2009 Chen et al. ..... 439/66
2002/0012015 A1 * 1/2002 Tsukada et al. ..... 347/7
2003/0051904 A1 * 3/2003 Aruga ..... 174/255
2003/0140694 A1 * 7/2003 Usui et al. ..... 73/290 V
2005/0208820 A1 * 9/2005 Sanuki ..... 439/372
2005/0237349 A1 * 10/2005 Nishihara ..... 347/7
2006/0172613 A1 * 8/2006 Sasaki ..... 439/824
2006/0250426 A1 * 11/2006 Wanibe et al. ..... 347/7
2007/0178719 A1 * 8/2007 Mendenhall et al. ..... 439/66
2008/0044175 A1 * 2/2008 Ilkawa ..... 396/542

FOREIGN PATENT DOCUMENTS

JP 2002-019136 A 1/2002
JP 2006168377 A * 6/2006

* cited by examiner

*Primary Examiner* — Charlie Peng
*Assistant Examiner* — Peter Radkowski
(74) *Attorney, Agent, or Firm* — Sughrue Mion, PLLC

(57) ABSTRACT

A liquid detection unit includes a unit case, a sensor, and a relay terminal. The sensor is held by the unit case. The relay terminal has a relay portion and first and second terminals that are provided on both ends of the relay portion. The second terminal is connected to the sensor. The unit case includes a first terminal holding portion, a second terminal holding portion, and a deformable portion. The first terminal holding portion holds the first terminal of the relay terminal. The second terminal holding portion holds the second terminal of the relay terminal. The deformable portion is provided between the first terminal holding portion and the second terminal holding portion, and elastically deforms in a direction in which a distance between the first terminal holding portion and the second terminal holding portion is reduced.

19 Claims, 15 Drawing Sheets

LIQUID DETECTION UNIT, AND LIQUID CONTAINER USING LIQUID DETECTION UNIT

BACKGROUND

1. Technical Field

The present invention relates to a liquid detection unit that is, for example, suitable for an ink cartridge, or the like, used for a printer, a liquid container that uses the liquid detection unit, and a method of manufacturing and method of disassembling a liquid container.

2. Related Art

In an existing art, ink jet printers serve as liquid ejecting apparatuses that eject liquid droplets from nozzles of liquid ejecting heads. Some ink jet printers include an off-carriage type ink supply system in which an ink cartridge is mounted at a position other than a carriage. The case in which this off-carriage type ink supply system is provided includes a case in which a large capacity ink cartridge is provided for large-sized print, a case in which the size of a carriage is reduced without mounting an ink cartridge and thereby an ink jet printer is made compact and slim, and the like. An ink detection unit is generally mounted on an ink cartridge for detecting the residual amount of ink. The off-carriage type ink cartridge is, for example, described in JP-A-2002-19136.

The ink detection unit includes a sensor, such as a piezoelectric element, and an electrical signal detected by the sensor is stored in a storage element on a circuit board that is mounted on the ink cartridge. A terminal on the ink detection unit side is elastically in contact with a fixed contact on the circuit board in order to maintain reliable electrical connection therebetween.

Therefore, in order to attach or detach the ink detection unit to or from the ink cartridge, both the connection between an ink containing package, which is accommodated in the ink cartridge, and the ink detection unit and the elastic connection between the fixed contact on the circuit board and the terminal on the ink detection unit side need to be considered, so that there has been a need for a simple mechanism.

SUMMARY

An advantage of some aspects of the invention is that it provides a liquid detection unit that allows easy connection/release of electrical connection to the fixed contact of a liquid container, or the like, a liquid container that uses the liquid detection unit and a method of manufacturing and method of disassembling a liquid container.

A first aspect of the invention provides a liquid detection unit. The liquid detection unit includes a unit case, a sensor, and a relay terminal. The sensor is held by the unit case. The relay terminal has a relay portion and first and second terminals that are provided on both ends of the relay portion. The second terminal is connected to the sensor. The unit case includes a first terminal holding portion, a second terminal holding portion, and a deformable portion. The first terminal holding portion holds the first terminal of the relay terminal. The second terminal holding portion holds the second terminal of the relay terminal. The deformable portion is provided between the first terminal holding portion and the second terminal holding portion, and elastically deforms in a direction in which a distance between the first terminal holding portion and the second terminal holding portion is reduced.

According to the first aspect of the invention, the position of the first terminal backs off by elastically deforming the deformable portion. When the liquid detection unit is attached to a liquid container, or the like, in this state, the first terminal does not interfere with the liquid container, or the like, when the first terminal approaches and then reaches a predetermined electrically connected position. Thus, it is less likely that deformation, or the like, of the relay terminal occurs, it is also possible to reduce poor connection, and, in addition, attachment manipulation of the liquid detection unit is easy. When the deformable portion is allowed to elastically return, it is possible to electrically connect the first terminal to the fixed contact of a circuit board, or the like.

In the first aspect of the invention, the deformable portion may include a slit, wherein the deformation portion may elastically deforms so as to reduce the groove width of the slit.

Thus, only by forming the shape of the unit case to have the slit, it is possible to form the deformable portion.

In the first aspect of the invention, the deformable portion may include a movable body (movable portion), a support body (support portion), and a connecting portion, wherein the movable body is provided on a side of the first terminal holding portion in such an orientation that the movable body intersects with a direction in which the relay portion of the relay terminal extends, wherein the support body is provided on a side of the second terminal holding portion in such an orientation that the support body intersects with the direction in which the relay portion of the relay terminal extends and is provided so as to be spaced apart from the movable body, and wherein the connecting portion connects the movable body and the support body. According to the above configuration, it is possible to define the slit by the movable body, the support body and the connecting portion.

In the first aspect of the invention, the movable body may have a proximal end that is connected to the connecting portion and a free end portion that extends from the proximal end, wherein the first terminal holding portion may be provided at the free end portion. According to the above configuration, it is possible to ensure a larger amount of displacement of the first terminal holding portion, that is, the first terminal.

In the first aspect of the invention, the liquid detection unit may further include an operating portion that is provided at the free end portion of the movable body for applying an external force to deform the deformable portion. According to the above configuration, because the deformable portion may be elastically deformed by manipulating the operating portion, it is easy to attach or detach the liquid detection unit.

In the first aspect of the invention, the connecting portion may include two upright portions and a link portion, wherein the two upright portions respectively extend upward from proximal ends thereof, the proximal ends being connected to the movable body and the support body, and wherein the link portion connects upper end portions of the two upright portions. According to the above configuration, it is possible for the two upright portions to function as a holding portion for applying an external force to deform the deformable portion.

In the first aspect of the invention, the connecting portion may be formed of an elastic member that is independent of the unit case.

In the first aspect of the invention, the relay terminal may be formed of a metal thin plate, wherein the relay portion may include a first thin plate portion and a second thin plate portion, wherein the first thin plate portion crosses over the movable body and the support body, wherein the second thin plate portion is bent at an end portion of the first thin plate portion and extends along the movable body, and wherein the first terminal may be bent at an end portion of the second thin plate portion and may be formed to protrude in a direction away from the movable body. According to the above configuration, the rigidity of the relay portion of the relay terminal is enhanced owing to a plurality of flexure portions and, hence, it tends to easily move following the movable body.

In the first aspect of the invention, the deformable portion may include a deformation guiding portion that deforms to guide the first thin plate portion by following deformation of the deformable portion. According to the above configuration, the relay terminal is further improved to follow the movable body.

In the first aspect of the invention, the first thin plate portion may include a reinforcing portion that is bent along the support body to be reinforced. According to the above configuration, the rigidity of the relay terminal is further enhanced and, therefore, the first terminal may be easily displaced to follow the deformable portion.

In the first aspect of the invention, the first terminal holding portion may movably hold the first terminal of the relay terminal, wherein the first terminal of the relay terminal may be urged to protrude in a direction in which the deformable portion elastically deforms and held by the first terminal holding portion. According to the above configuration, after the deformable portion has elastically returned as well, it is possible to apply an elastically pressing force to the first terminal.

In the first aspect of the invention, the first terminal may include an elongate hole having a longitudinal direction in a direction in which the first terminal is urged to protrude, wherein the first terminal holding portion of the unit case may include a protruding portion that is inserted in the elongate hole. According to the above configuration, it is possible to movably hold the first terminal by the first terminal holding portion.

A second aspect of the invention provides a liquid container. The liquid container includes a liquid containing package, a case, and the liquid detection unit. The liquid containing package contains liquid. The case has a liquid container portion that accommodates the liquid containing package and is provided with a fixed contact. The liquid detection unit that is formed according to the above aspect of the invention is connected through an attachment portion, which is provided in the case, to a liquid delivery portion of the liquid containing package. The relay terminal of the liquid detection unit is configured so that the first terminal is connected to the fixed contact.

In the liquid container according to the second aspect of the invention, by using the deformable portion of the liquid detection unit, attachment or detachment of the liquid detection unit is easy.

In the second aspect of the invention, the liquid detection unit may be fitted by rotating about the attachment portion. The liquid detection unit is connected to the liquid containing package that is accommodated in the liquid container, so that rotating manipulation is most desirable when a liquid container unit, which maintains the above connection, is electrically connected or disconnected.

In the second aspect of the invention, the case may include a detection unit accommodating portion that accommodates the liquid detection unit, a partition wall that defines the liquid container portion and the detection unit accommodating portion and that has the attachment portion, and a side wall that defines the detection unit accommodating portion together with the partition wall and that holds a circuit board, wherein the fixed contact may be provided in the circuit board. By utilizing the deformable portion of the liquid detection unit, it is possible to simplify an operation to connect or disconnect the first terminal of the liquid detection unit to or from the circuit board that is provided on the side wall of the liquid container.

In the second aspect of the invention, the side wall may include a board holding portion that holds the circuit board in such an orientation that the circuit board exposes a front face thereof, wherein the fixed contact, which the first terminal contacts, is formed on a rear face of the circuit board, wherein the board holding portion includes first and second engaging portions that engage the circuit board at both sides intervening the fixed contact in one side direction of the circuit board, wherein the first and second engaging portions engage the circuit board by means of thermal caulking, wherein the circuit board may include a bending deformable portion that is formed between the fixed contact and the second engaging portion in the one side direction.

According to the above configuration, even if the strength of the thermally caulked portions of the first and second engaging portions is weak, when the first terminal is pressed to contact the fixed contact, the circuit board that is deformed at the bending deformable portion is able to reduce a force applied to the thermally caulked portions of the first and second engaging portions. Thus, it is possible to prevent the circuit board from falling off. The bending deformable portion may be anything that makes the circuit board to easily bend to deform and, for example, may be formed of a cutout portion formed in the circuit board.

In the second aspect of the invention, the case may include a positioning portion that positions the liquid detection unit in a state where the first terminal of the liquid detection unit is connected to the fixed contact. According to the above configuration, it is possible to maintain the electrical connection.

In the second aspect of the invention, the positioning portion may hold the deformable portion so as not to deform after the liquid detection unit has been attached. According to the above configuration, unless an excessive external force is applied to the deformable portion, it is possible to maintain electrical connection that is resistant to vibration.

A third aspect of the invention provides a liquid container. The liquid container includes a liquid containing package, a case, and a liquid detection unit. The liquid containing package contains liquid. The case has a liquid container portion that accommodates the liquid containing package and is provided with a fixed contact. The liquid detection unit is connected through an attachment portion, which is provided in the case, to a liquid delivery portion of the liquid containing package. The liquid detection unit has the slit that is defined by the movable body, the support body and the connecting portion as described above. The case includes a positioning portion that positions the liquid detection unit in a state where the first terminal of the liquid detection unit is connected to the fixed contact. The liquid detection unit includes a positioned portion that is formed by extending the movable body beyond the connecting portion. The positioning portion is in contact with the positioned portion.

According to the third aspect of the invention, because the positioning portion is in contact with the positioned portion, deformation of the deformable portion is restricted. Thus, unless an excessive external force is applied to the deformable portion, it is possible to maintain electrical connection that is resistant to vibration.

A fourth aspect of the invention provides a method of manufacturing the liquid container according to the second or third aspect of the invention. The method includes attaching the liquid detection unit to the detection unit accommodating portion by deforming the deformable portion, and electrically connecting the first terminal to the fixed contact by allowing the deformable portion to elastically return.

A fifth aspect of the invention provides a method of disassembling the liquid container according to the second or third aspect of the invention. The method includes releasing electrical connection between the first terminal and the fixed contact by deforming the deformable portion, and removing the liquid detection unit from the detection unit accommodating portion by maintaining deformation of the deformable portion.

In the method of manufacturing the above described liquid container, it is less likely that deformation, or the like, of the relay terminal occurs, it is also possible to reduce poor connection, and, in addition, attachment manipulation of the liquid detection unit is easy. When the deformable portion is allowed to elastically return, it is possible to elastically connect the first terminal to the fixed contact of the circuit board, or the like, so that the reliability is improved. In the method of disassembling the above described liquid container, it is less likely that deformation, or the like, of the relay terminal occurs, and it is also possible to remove the liquid detection unit without breakage thereof. Thus, it is possible to reuse the liquid container unit.

BRIEF DESCRIPTION OF THE DRAWINGS

The invention will be described with reference to the accompanying drawings, wherein like numbers reference like elements.

FIG. 13A and FIG. 13B are views, each of which illustrates fitting of the liquid detection unit, in which FIG. 13B is an enlarged view of a portion XIIIB shown in FIG. 13A.

DESCRIPTION OF EXEMPLARY EMBODIMENTS

An embodiment according to the invention will now be described. Note that the embodiment described below does not intend to limit the scope of the invention recited in the appended claims, and all the components described in the embodiment are not always necessary as a solution of the invention.

Overview of Liquid Ejecting Apparatus

Figure 1:
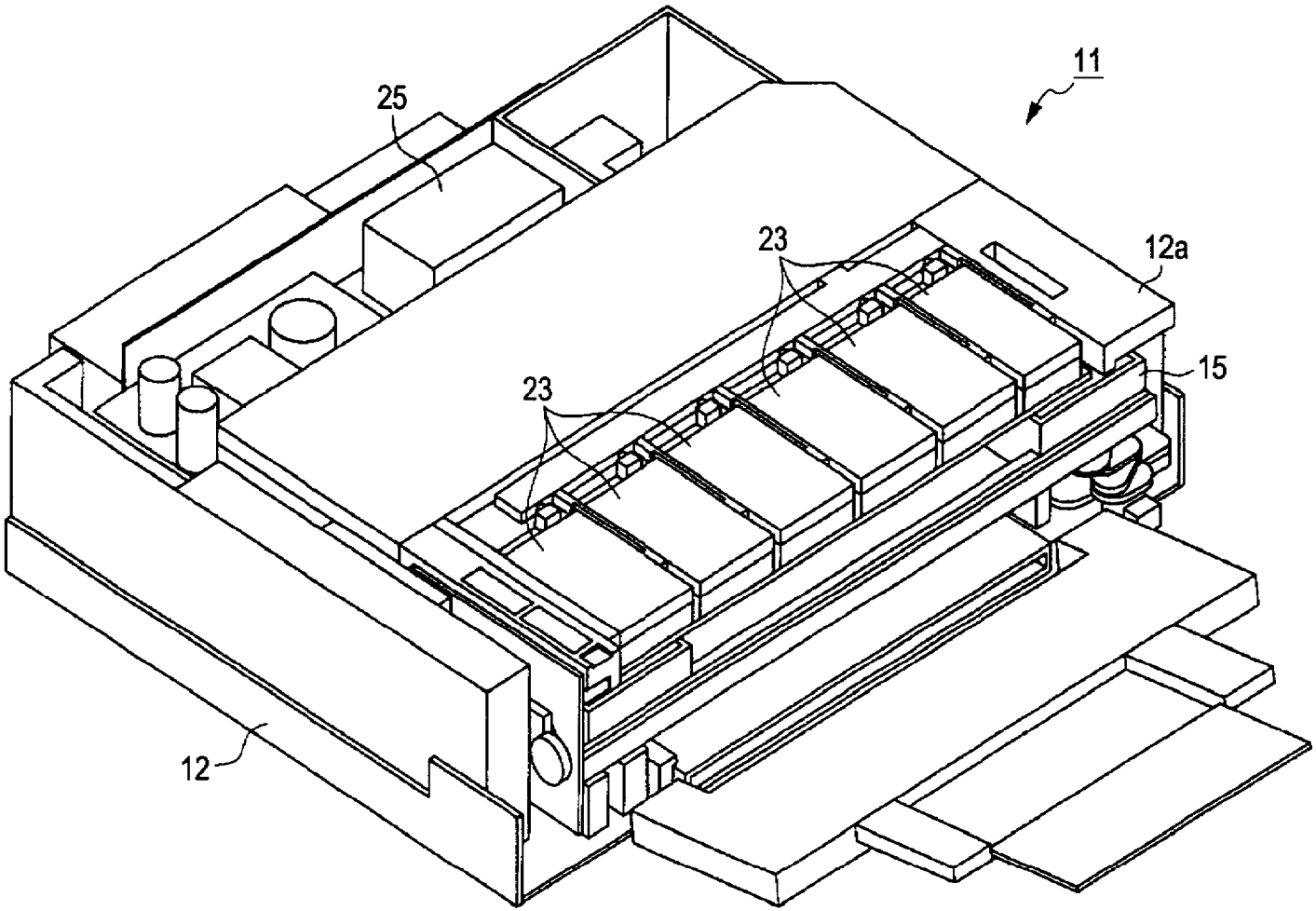
FIG. 1 is a perspective view of a printer according to an embodiment of the invention.

As shown in FIG. 1, a printer 11, which serves as a liquid ejecting apparatus according to the present embodiment, is covered with a frame 12. Then, inside the frame 12, as shown in FIG. 2, a guide shaft 14, a carriage 15, a recording head 20, which serves as a liquid ejecting head, valve units 21, ink cartridges 23 (see FIG. 1), which serve as liquid containing bodies, and a pressurizing pump 25 (see FIG. 1).

As shown in FIG. 1, the frame 12 has a substantially rectangular parallelepiped and box-shaped body, and a cartridge holder 12*a* is formed at the front side of the frame 12.

Figure 2:
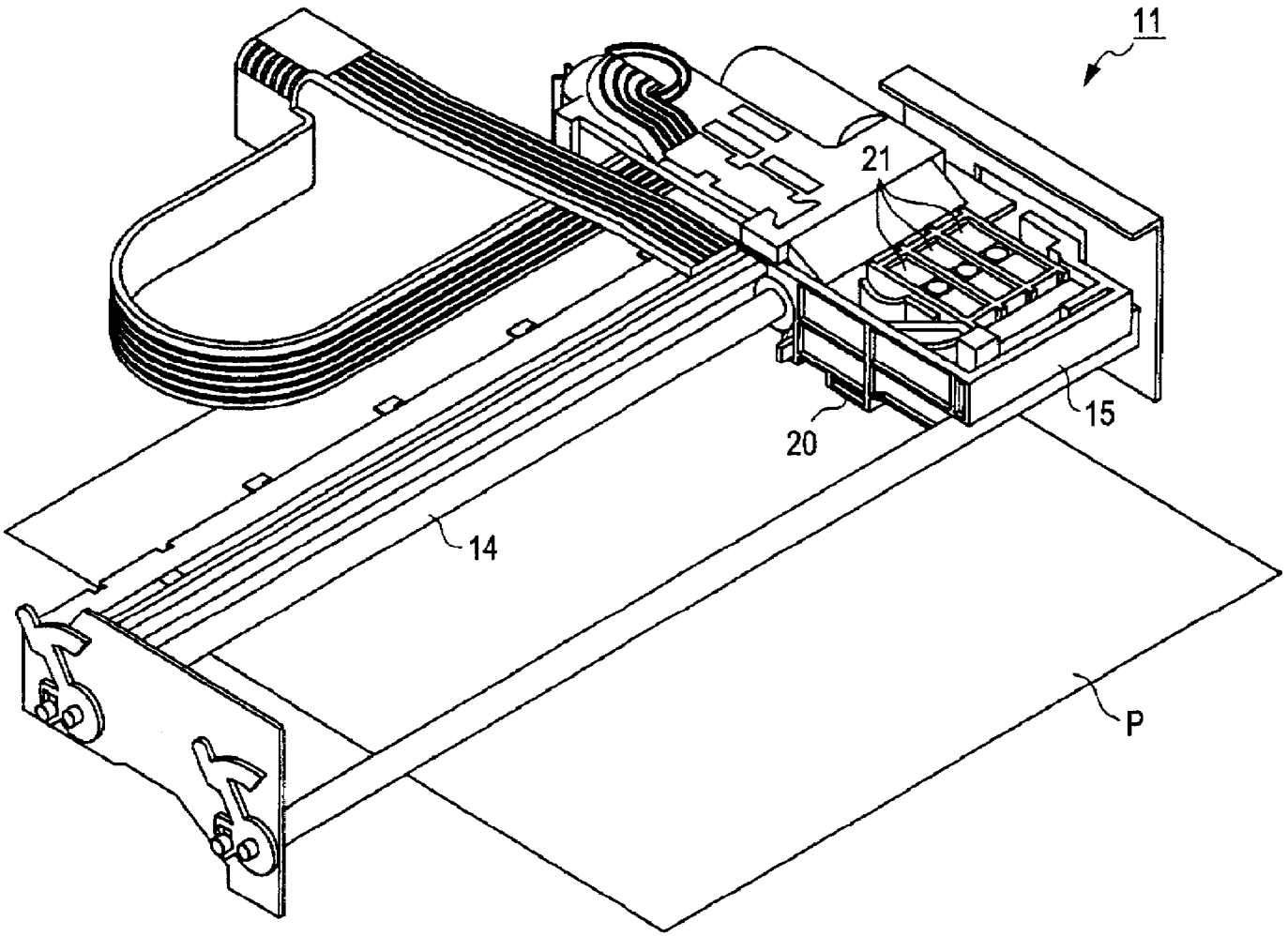
FIG. 2 is an exploded perspective view of the printer shown in FIG. 1.

As shown in FIG. 2, the guide shaft 14 is formed into a columnar shape and is provided so as to extend inside the frame 12. Note that, in the present embodiment, the direction in which the guide shaft 14 extends is referred to as a main scanning direction. The carriage 15 is movably attached to the guide shaft 14 so as to be movable relative to the guide shaft 14. Thus, the carriage 15 is movable reciprocally in the main scanning direction. Then, the carriage 15 is operatively connected to a carriage motor (not shown) through a timing belt (not shown). The carriage motor is supported by the frame 12. As the carriage motor is driven, the carriage 15 is driven through the timing belt and then the carriage 15 is reciprocally moved along the guide shaft 14, that is, in the main scanning direction.

The recording head 20 is provided at the lower side of the carriage 15. The recording head 20 includes a plurality of nozzles (not shown) that eject ink (including water-based ink or oil-based ink) as liquid, and performs recording of print data, such as images or characters, by discharging ink droplets onto a print medium, such as a recording sheet of paper. The valve units 21 are mounted on the carriage 15. Each of the valve units 21 temporarily accumulates ink and then supplies the ink to the recording head 20 in a state where the pressure of the ink is adjusted.

Note that, in the present embodiment, the valve units 21 each are configured to be able to supply separately two types of ink for each valve unit 21 to the recording head 20 in a state where the pressure of the ink is adjusted. Then, in the present embodiment, three valve units 21 are provided in total and correspond to six colors of ink (black, yellow, magenta, cyan, light magenta, and light cyan).

Incidentally, a platen (not shown) is provided below the recording head 20. The platen supports a recording sheet of paper P, which is a target transported by a transport device (not shown) in a sub-scanning direction perpendicular to the main scanning direction.

Liquid Container

Figure 3:
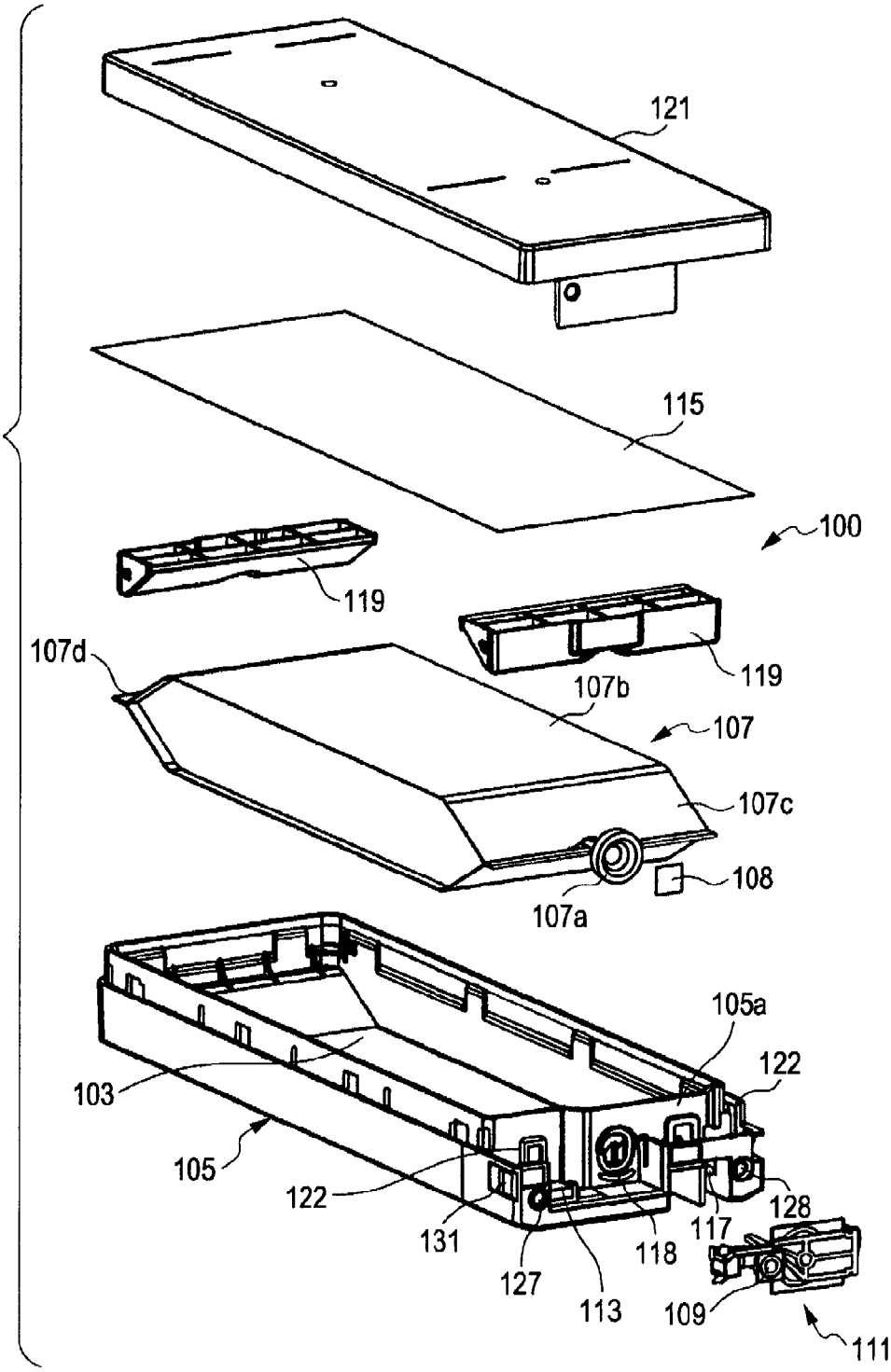
FIG. 3 is an exploded perspective view of an ink cartridge shown in FIG. 1.
Figure 4:
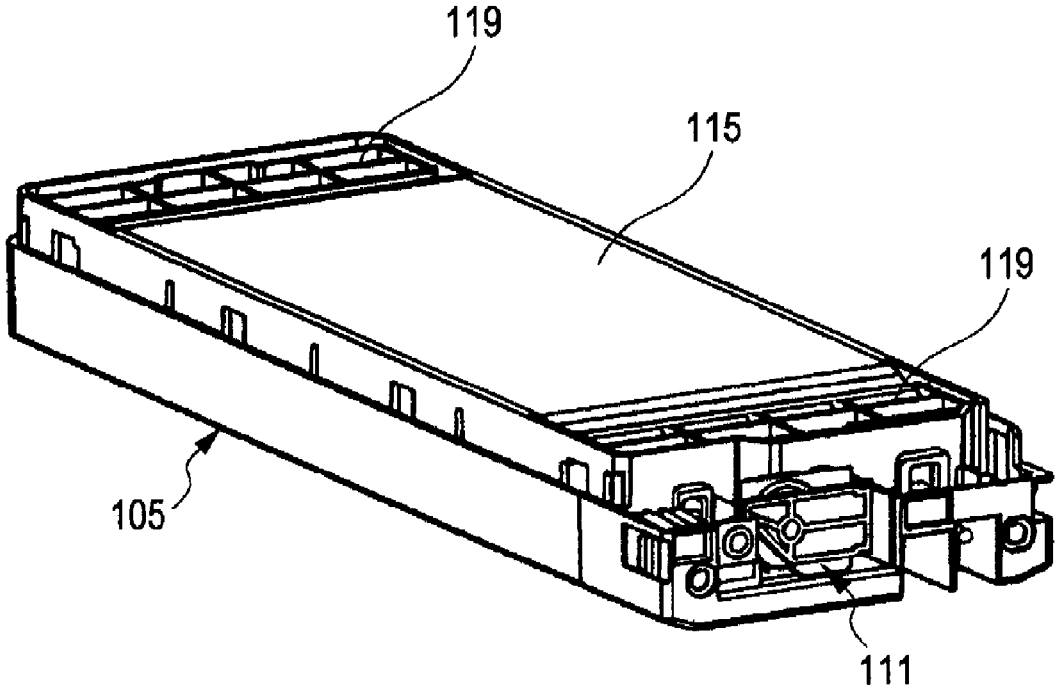
FIG. 4 is an internal structural drawing of the ink cartridge.
Figure 5:
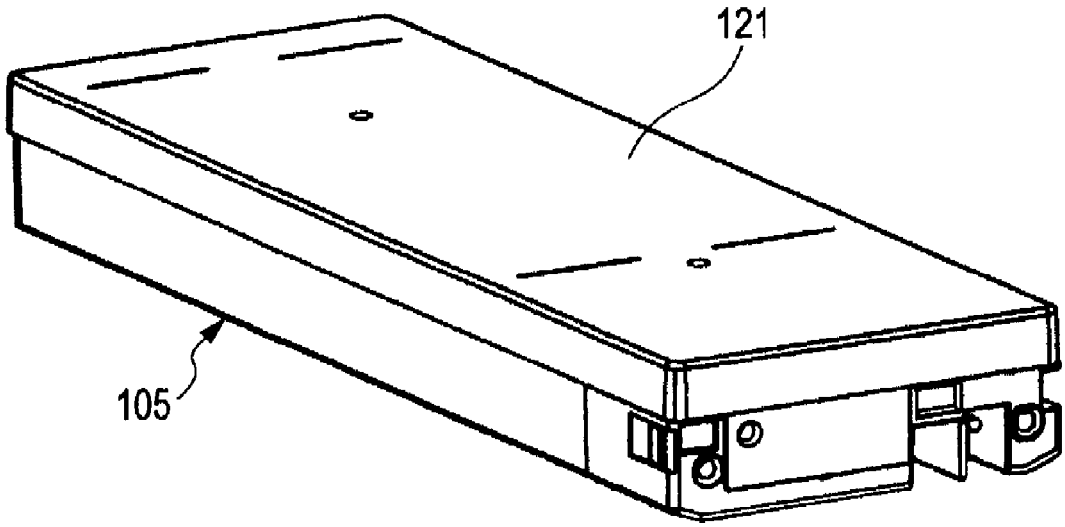
FIG. 5 is an external view of the ink cartridge.
Figure 6A:
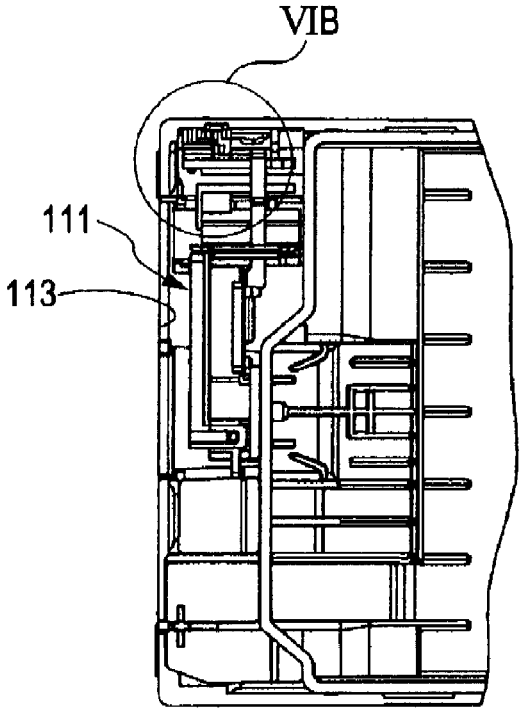
FIG. 6A is a partially plan view of the ink cartridge on which a liquid detection unit is mounted.
Figure 6B:
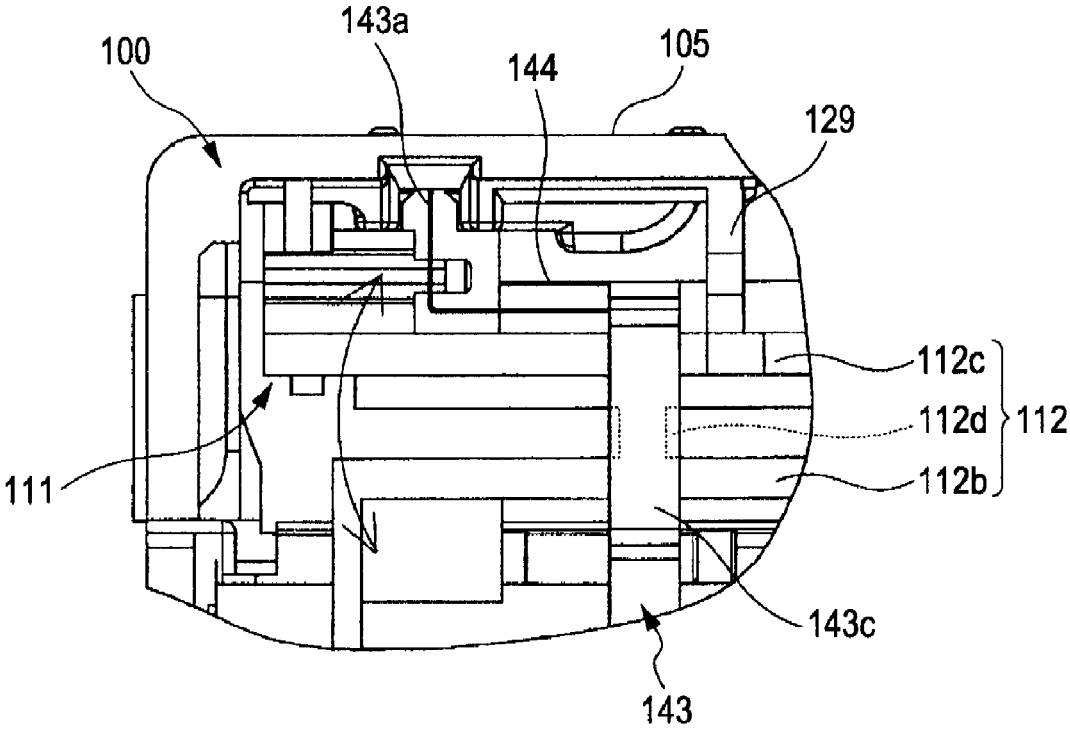
FIG. 6B is an enlarged view of a region VIB shown in FIG. 6A.
Figure 7:
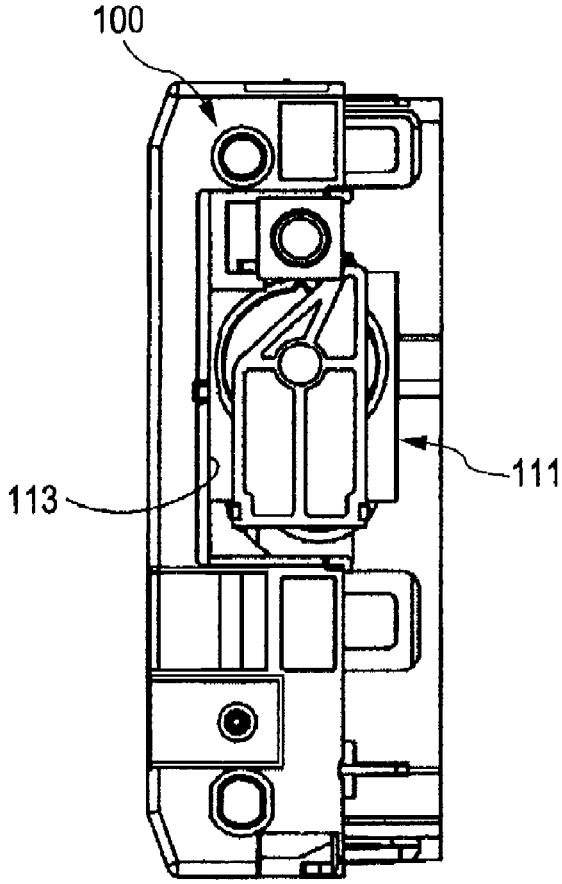
FIG. 7 is a side view of the ink cartridge on which the liquid detection unit is mounted.

FIG. 3 is an exploded perspective view of the ink cartridge that is one embodiment of a liquid container. FIG. 4 is an internal structural drawing of the ink cartridge. FIG. 5 is an external view of the ink cartridge. FIG. 6A is a partially plan view of the ink cartridge on which a liquid detection unit 111 is mounted. FIG. 6B is an enlarged view of a region VIB shown in FIG. 6A. FIG. 7 is a side view of the ink cartridge on which the liquid detection unit 111 is mounted.

The ink cartridge 100 shown in FIG. 3 is detachably attached to a cartridge attachment portion of a commercial ink jet recording apparatus and supplies ink to a recording head (liquid ejecting head) provided in the recording apparatus.

The ink cartridge 100 includes a case body (case) 105, an ink pack 107 and a liquid detection unit 111. The case body 105 defines an ink pack accommodating portion 103 to which pressure is applied by a pressurizing device. The ink pack 107, which serves as a liquid containing portion, accumulates ink and is accommodated in the ink pack accommodating portion 103. The ink pack 107 delivers the accumulated ink from an ink delivery member (liquid delivery portion) 107*a* by applying pressure to the ink pack accommodating portion 103. The liquid detection unit 111 has another ink delivery member (liquid delivery member) 109 that supplies ink to the recording head, which is an external liquid consuming device and is detachably attached to the case body 105.

The case body 105 is a cabinet formed by resin molding. A substantially box-shaped upper side open ink pack accommodating portion 103 and a detection unit accommodating portion 113 that is located to the front face side of the ink pack accommodating portion 103 and that accommodates the liquid detection unit 111 are defined in the case body 105. As shown in FIG. 6A, the liquid detection unit 111 is accommodated in the detection unit accommodating portion 113.

The open face of the ink pack accommodating portion 103, after accommodating the ink pack 107, is sealed by a sealing film 115. Thus, the ink pack accommodating portion 103 becomes a hermetically sealed chamber.

A partition wall 105*a* partitions the ink pack accommodating portion 103 and the detection unit accommodating portion 113. The partition wall 105*a* has a pressurizing port 117, which is a communication passage for supplying pressurized air into the ink pack accommodating portion 103 that is formed as the hermetically sealed chamber by the sealing film 115. When the ink cartridge 100 is attached to the cartridge attachment portion of the ink jet recording apparatus, a pressurized air supplying device provided on the cartridge attachment portion side is connected to the pressurizing port 117. Thus, the ink pack 107 may be pressurized by the pressurized air supplied into the ink pack accommodating portion 103.

The ink pack 107 is formed so that a cylindrical ink delivery member 107*a*, to which a connection needle 111*a* of the liquid detection unit 111 (see FIG. 12B), is connected to one end of a flexible package body 107*b* formed of a multilayer sealing film.

Detection Unit Accommodating Portion

Next, with reference to FIG. 8, FIG. 9A and FIG. 9B, the detection unit accommodating portion 113 outside the partition wall 105*a* will be described. The detection unit accommodating portion 113 accommodates the liquid detection unit 111, which will be described in FIG. 10 and later, so that the liquid detection unit 111 is connected to the ink pack 107, and the detection unit accommodating portion 113 electrically connects the circuit board 131, shown in FIG. 8, to the liquid detection unit 111.

Figure 9A:
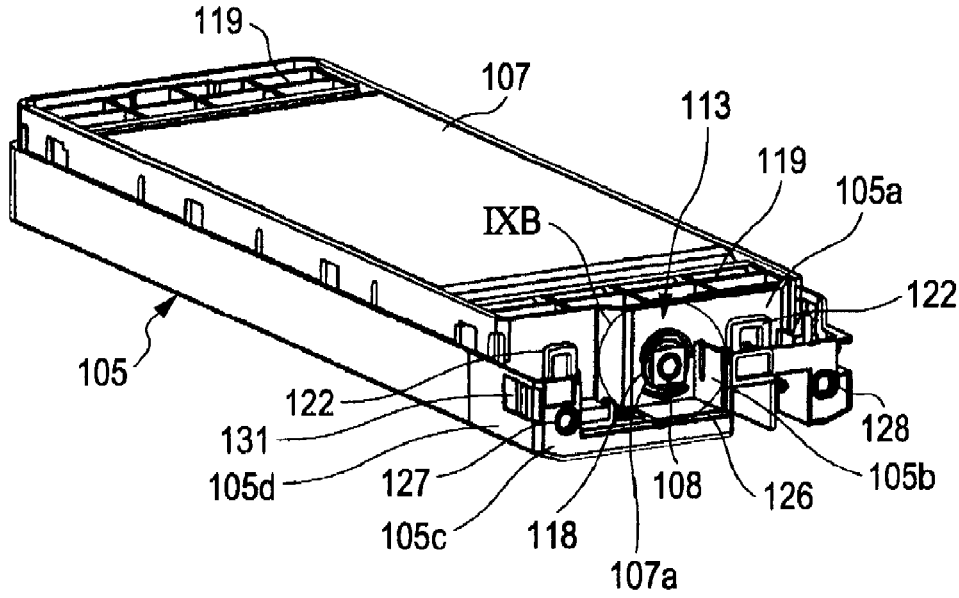
FIG. 9A is a perspective view of the ink cartridge.
Figure 9B:
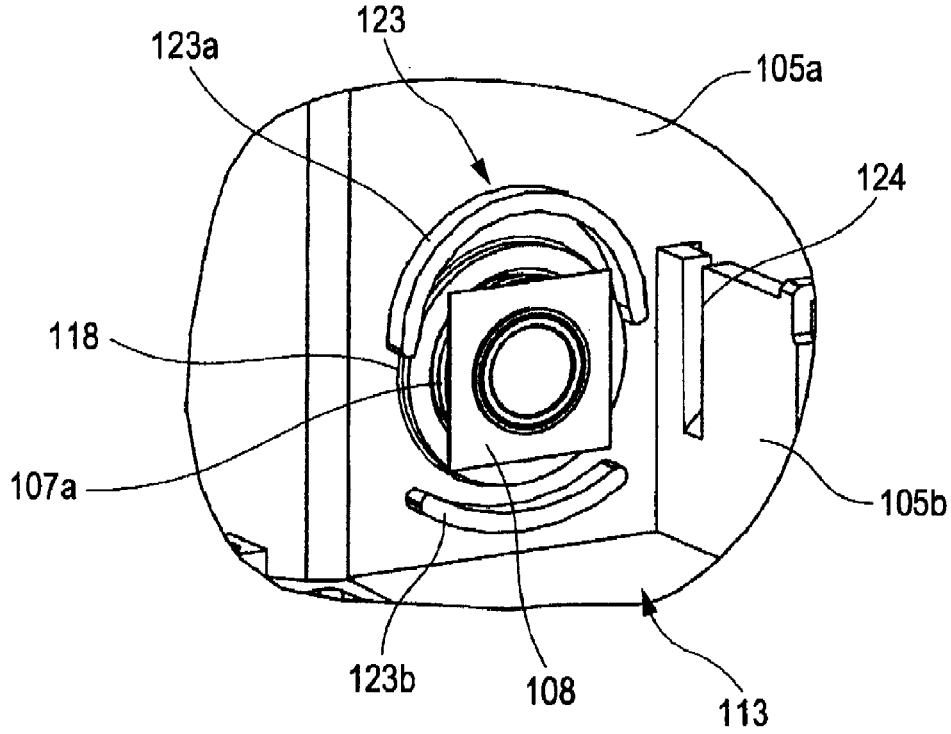
FIG. 9B is an enlarged view of a portion IXB shown in FIG. 9A at an opening for inserting a connecting port.

The ink delivery member 107*a* of the ink pack 107 is hermetically inserted through an opening 118 for inserting a connecting port, which is formed in the partition wall 105*a*, and the distal end of the ink delivery member 107*a* extends into the detection unit accommodating portion 113 as shown in FIG. 9A and FIG. 9B.

Here, as shown in FIG. 9B, a sealing film 108 is also welded to the ink delivery member 107*a*. The sealing film 108 is welded to an open end face of the ink delivery member 107 and also to an end face of a seal member (not shown) that is arranged on the ink delivery member 107*a*.

The ink pack 107 is filled with ink that is adjusted in advance to a state of high deaeration degree before the liquid detection unit 111 is connected, and is sealed by the sealing film 108.

When the ink pack 107 is attached to the ink pack accommodating portion 103, resin spacers 119 are attached on the inclined portions 107*c* and 107*d* formed on the front and rear sides of the flexible package body 107*b*, respectively. The resin spacers 119, when the upper face of the ink pack accommodating portion 103 is covered with the sealing film 115 and then the ink pack accommodating portion 103 becomes the sealed chamber, prevent the ink pack 107 from rattling in the sealed chamber, while, at the same time, the resin spacers 119 occupy an extra empty space in the sealed chamber. Thus, the resin spacers 119 enhance pressurizing efficiency when the ink pack accommodating portion 103 is applied with pressure using pressurized air.

A resin cover 121 is attached above the detection unit accommodating portion 113 and the sealing film 115. When the cover 121 is placed on the case body 105, an engaging device (not shown) is engaged with an engaging portion 122 provided on the case body 105 side, so that the cover 121 is fixed to the case body 105.

Around the opening 118 that opens in the partition wall 105*a*, as shown in FIG. 9B, a fitting portion 123, to which the liquid detection unit 111 is fitted by a predetermined operation, is provided.

In the case of the present embodiment, the fitting portion 123 has a fitted structure that the liquid detection unit 111 is rotatably fitted to the fitting portion 123, and is provided at a position that is spaced a distance from the circuit board 131, which will be described later, on the case body 105. Specifically, the fitting portion 123 includes two bent protruded walls 123*a* and 123*b*, and forms a ring structure by these protruded walls 123*a* and 123*b* to restrict rotation of the liquid detection unit 111. In addition, the structure of the fitting portion 123 may employ a decentered structure in which a rotary shaft decenters when the liquid detection unit 111 is fitted to the fitting portion 123 as it is rotated. As the liquid detection unit 111 is fitted to the detection unit accommodating portion 113, relay terminals 143 and 144 (see FIG. 10) are connected to terminals (contacts) 131*d* (see FIG. 13B) of the case body 105. The case body 105 is provided with a rib, which serves as a positioning portion 129 (see FIG. 6B and FIG. 11). Because the positioning portion 129 is provided, it is easy to regulate the position when the liquid detection unit 111 is fitted. The positioning portion 129, after the liquid detection unit 111 is attached, serves to fix a deformable portion 112 (see FIG. 6B, FIG. 12A and FIG. 12B) so as not to deform.

In addition, as shown in FIG. 9B, a partition wall 105*b* (see FIG. 9A and FIG. 9B) is formed in the detection unit accommodating portion 113 at a position adjacent to the fitting portion 123 so as to be perpendicular to the partition wall 105*a*. The partition wall 105*b* is provided with an engaging groove 124 that prevents the liquid detection unit 111, fitted to the fitting portion 123, from falling off.

A front face wall 105*c* of the case body 105, which is a partition wall that covers the front face side of the detection unit accommodating portion 113, has an opening 126, formed of a cutout, at a position that faces the fitting portion 123 for fitting the liquid detection unit 111.

Note that, as shown in FIG. 9A, positioning holes 127 and 128, into which positioning pins provided on the cartridge attachment portion side are inserted when the ink cartridge 100 is attached to the cartridge attachment portion, are provided at both side portions of the front face wall 105*c*.

Figure 8:
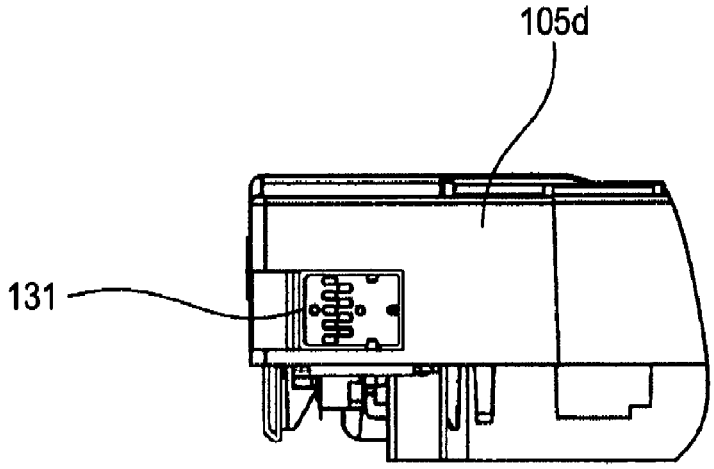
FIG. 8 is a partially side view of the ink cartridge on which a circuit board is mounted.

On a side wall of the case body 105 adjacent to the positioning hole 127, as shown in FIG. 8 and FIG. 9A, a circuit board 131 is provided at a position adjacent to the front face of the side wall 105*d* of the case body 105. The circuit board 131, when the ink cartridge 100 is attached to the cartridge attachment portion, contacts a connecting terminal provided on the cartridge attachment portion side to thereby establish electrical connection. The circuit board 131 has a plurality of contacts that contact the connecting terminal provided on the cartridge attachment portion side.

Figure 13A:
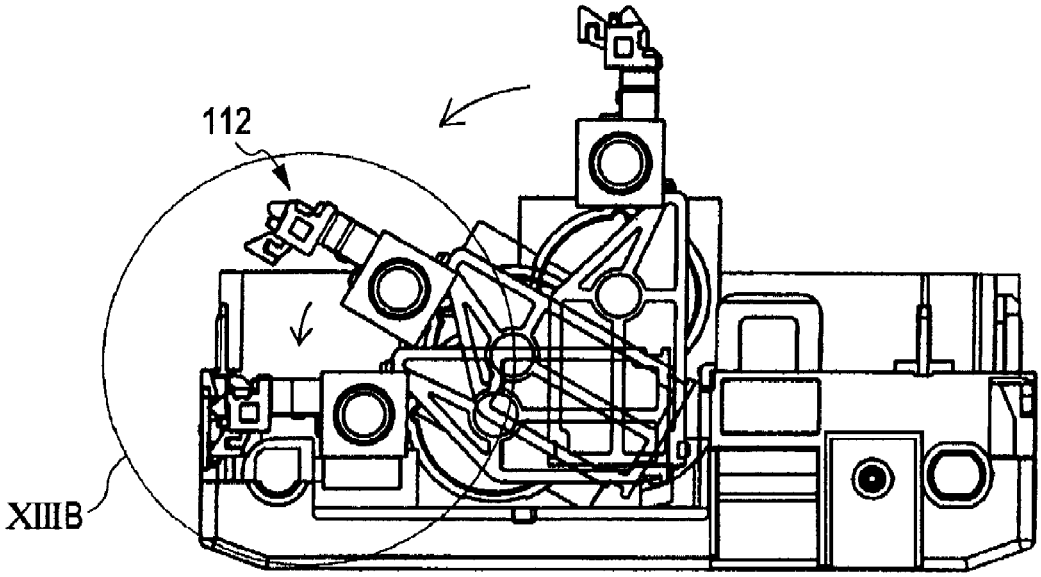
Figure 13B:
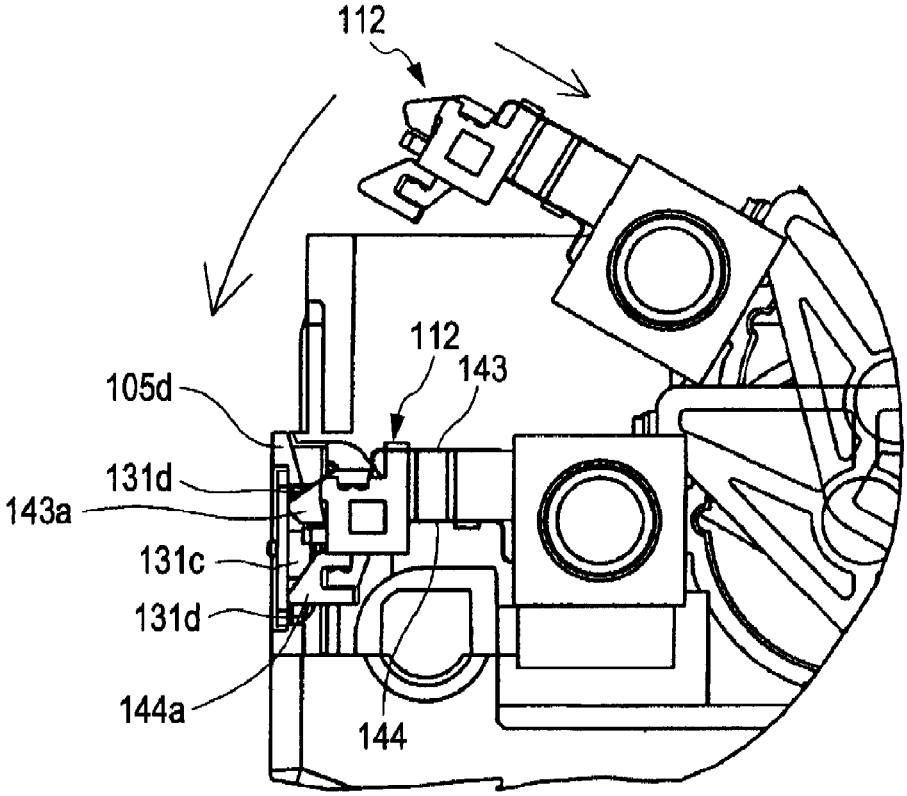

In addition, on the rear face of the circuit board 131, as shown in FIG. 13B, a memory element 131*c* is mounted, and fixed contacts 131*d* are formed. The memory element 131*c* records information of the residual amount of ink, the usage history of cartridge, or the-like. The fixed contacts 131*d* electrically connect a sensor member (including piezoelectric element, and hereinafter, simply referred to as "sensor member") 132 (see FIG. 10) to the connecting terminal of the ink jet recording apparatus side through relay terminals 143 and 144. The sensor member 132 is mounted on the liquid detection unit 111 and detects the status of the residual amount of liquid. Thus, when the ink cartridge 100 (see FIG. 3) is attached to the cartridge attachment portion of the recording apparatus and then contacts (not shown) of the surface of the circuit board 131 are connected to the connecting terminal on the cartridge attachment portion side, the memory element 131*c* and the sensor member 132 are electrically connected to a control circuit on the recording apparatus side through the circuit board 131, so that the operations of these memory element 131*c* and sensor member 132 may be controlled from the recording apparatus side.

Liquid Detection Unit

The liquid detection unit 111 according to the present embodiment, as shown in FIG. 10 to FIG. 13B, includes a resin unit case 133, the sensor member 132, an electrically insulative sensor sealing film 142, and the pair of metal plate relay terminals 143 and 144. The unit case 133 is fitted to the case body 105 by rotating manipulation. The sensor member 132 is fixed to the rear face side of the unit case 133 through a sensor base 141. The sensor sealing film 142 covers the surface, and the like, of the sensor base 141 around the sensor member 132. The pair of relay terminals 143 and 144 are fitted to the unit case 133 from above the sensor sealing film 142 so as to connect the terminals on the sensor member 132 to the fixed contacts 131*d* (see FIG. 13A and FIG. 13B) of the rear face of the circuit board 131 (see FIG. 8).

The unit case 133 includes an ink delivery member 109, a case body 133*a*, a flow passage forming member 133*c*, a pressure chamber sealing film 156, and a cover 133*b*. The ink supply needle (liquid delivery needle) on the cartridge attachment portion side is inserted and connected to the ink delivery member 109. The case body 133*a* has an internal flow passage space 146 that is in fluid communication with the ink delivery member 109. The flow passage forming member 133*c* is placed in an internal flow passage space 146 and then forms a flow passage that is in fluid communication with the ink delivery member 109 in cooperation with the internal flow passage space 146. The pressure chamber sealing film 156 is welded to the end face of the case body 133*a* and seals the open face of the internal flow passage space 146 to thereby define a pressure chamber for detecting the residual amount. The cover 133*b* covers and protects the pressure chamber sealing film 156.

The cover 133*b* is rotatably connected to the case body 133*a* in such a manner that an engaging shaft 152 extending from the outer periphery of the case body 133*a* is fitted to a hole 151*a* of an engaging piece 151 extending from the proximal end side. In addition, the cover 133*b* is fixed to the cover body 133*a* by connecting the distal end side to the case body 133*a* using a spring 153.

A flow passage open/close mechanism 155 is attached to the ink delivery member 109 and opens a flow passage when the ink supply needle on the cartridge attachment portion side is inserted. The flow passage open/close mechanism 155 includes a cylindrical seal member 155*a*, a valve body 155*b* and a spring member 155*c*. The seal member 155*a* is fixed to the ink delivery member 109. The valve body 155*b* holds the flow passage in a closed state by being seated on the seal member 155*a*. The spring member 155*c* urges the valve body 155*b* in a direction in which the seal member 155*a* is seated.

Figure 10:
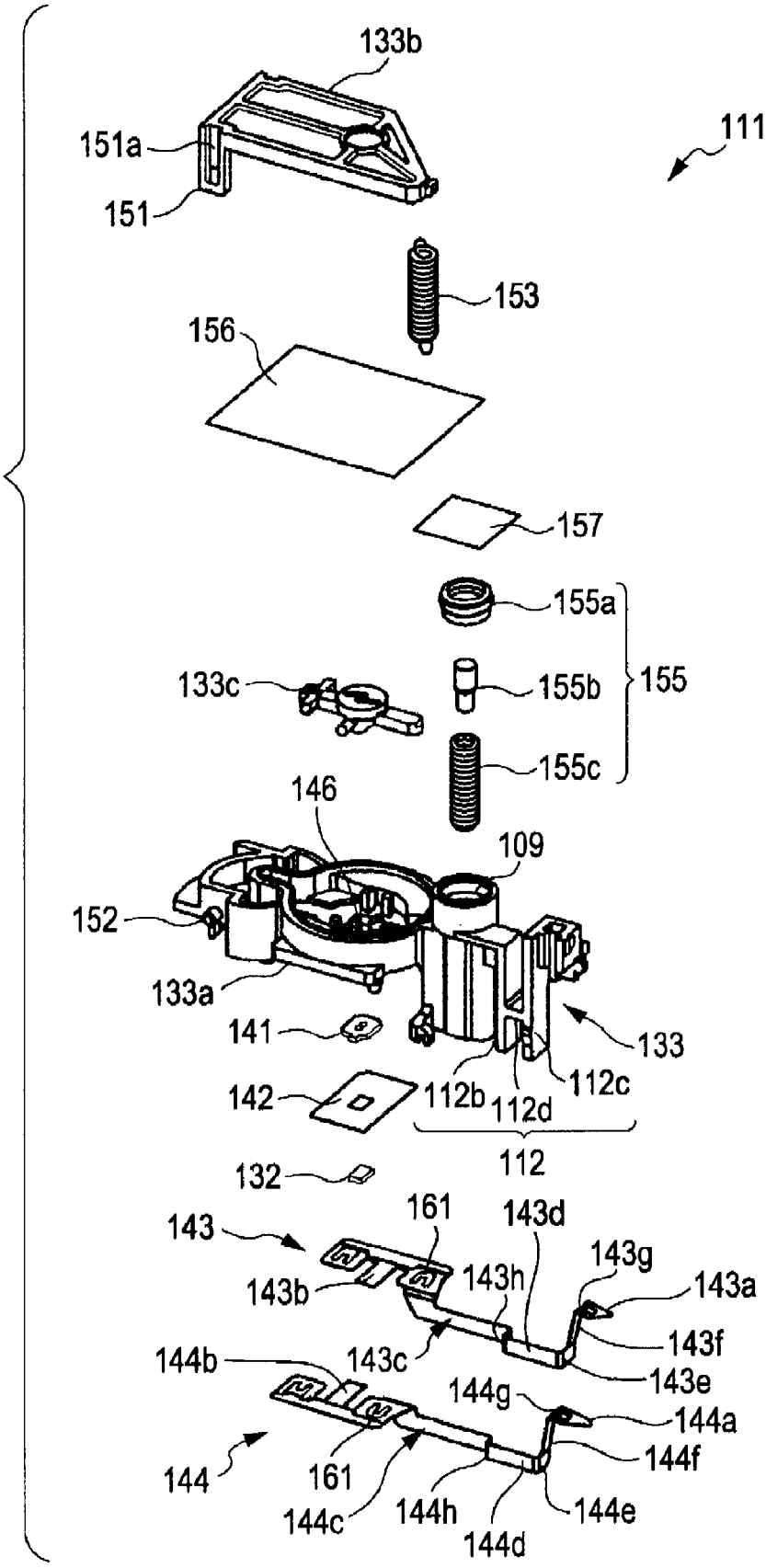
FIG. 10 is an exploded perspective view of the liquid detection unit.

The open end of the ink delivery member 109 to which the flow passage open/close mechanism 155 is attached is sealed by a sealing film 157 (see FIG. 10). The sealing film 157 is welded to the open end face of the ink delivery member 109 and also to the end face of the seal member 155*a* that is attached to the ink delivery member 109.

As the ink cartridge 100 is attached to the cartridge attachment portion of the recording apparatus, the ink supply needle provided in the cartridge attachment portion breaks through the sealing film 157 and then is inserted into the ink delivery member 109. At this time, the ink supply needle inserted in the liquid delivery member 109 separates the valve body 155*b* from the seal member 155*a*, so that the flow passage in the unit case 133 is in fluid communication with the ink supply needle. Thus, it is possible to supply ink to the recording apparatus side.

Figure 12A:
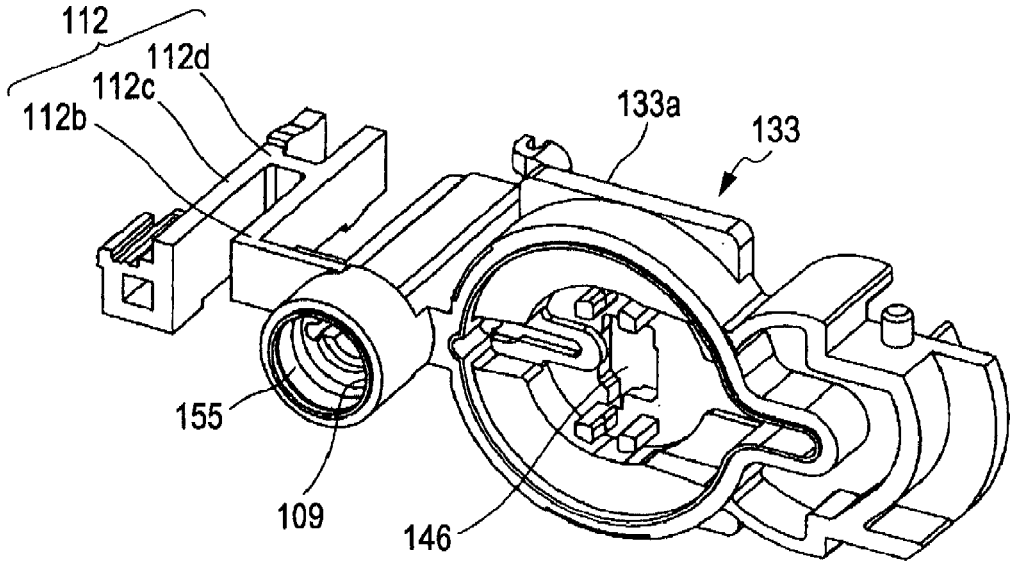
FIG. 12A and FIG. 12B are schematic perspective views of a case body of the liquid detection unit.
Figure 12B:
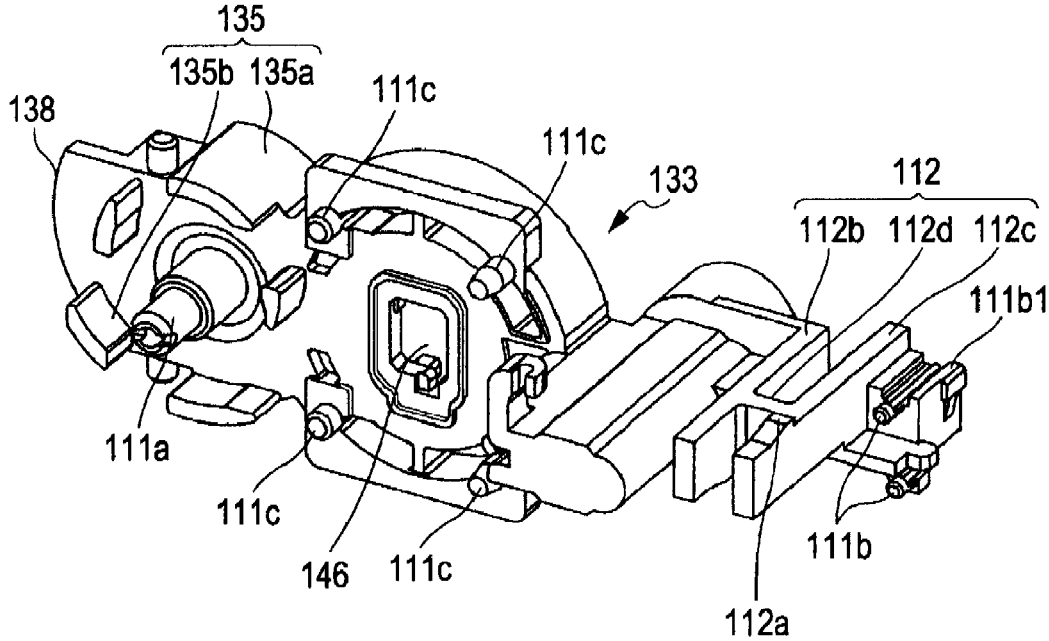

Furthermore, as shown in FIG. 12B, the case body 133*a* has a case fitting portion 135 at a position corresponding to the fitting portion 123 (see FIG. 9B) of the case body 105 at its rear face side. The case fitting portion 135 is rotatably fitted to the fitting portion 123. The connection needle 111*a* is provided inside the case fitting portion 135. The connection needle 111*a* is inserted and connected to the ink delivery member 107*a* of the ink pack 107. The connection needle 111*a* breaks through the sealing film 108 shown in FIG. 3 and FIG. 9B and then is inserted into the ink delivery member 107*a*. In this manner, a valve mechanism provided in the ink delivery member 107*a* is opened to thereby allow ink to be delivered. That is, the connection needle 111*a*, as in the case of the above ink supply needle, functions as a liquid delivery needle. The flow passage that is formed by the internal flow passage space 146 and the flow passage forming member 133*c* (see FIG. 10 and FIG. 12A) is an internal flow passage that establishes fluid communication between the ink delivery member 109 and the connection needle 111*a*.

The sensor member 132 is a piezoelectric sensor that is fixed to the rear face side of the case body 133*a* so as to be able to apply vibration to the internal flow passage. The sensor member 132 outputs a variation in residual vibration in accordance with a variation in flow rate (pressure) of ink in the internal flow passage as an electrical signal. The residual amount of ink in the ink pack 107 is detected in such a manner that the control circuit on the recording apparatus side analyzes the output signal of the sensor member 132.

In the case of the present embodiment, the case fitting portion 135, as shown in FIG. 12B, is provided with two bent protruded walls 135*a* and 135*b* that are rotatably fitted to the protruded walls 123*a* and 123*b* (see FIG. 9B) of the fitting portion 123. These protruded walls 135*a* and 135*b* form a ring structure that restricts rotation of the liquid detection unit 111.

An engaging piece 138 is provided around the case fitting portion 135 that is provided on the case body 133*a*. The engaging piece 138, when the liquid detection unit 111 is rotated in a direction indicated by the arrow shown in FIG. 13A from the state in which the case fitting portion 135 is fitted to the fitting portion 123 (see FIG. 9B), engages the engaging groove 124 (see FIG. 9B) on the case body 105 side to thereby prevent the case fitting portion 135 (liquid detection unit 111) from falling off.

Next, with reference to FIG. 10 to FIG. 15, the liquid detection unit 111 will be more specifically described.

The liquid detection unit 111 includes the unit case 133 and the relay terminals 143 and 144. The relay terminals 143 and 144, as shown in FIG. 10, include relay portions 143*c* and 144*c*, first terminals 143*a* and 144*a* to the one ends of the relay portions 143*c* and 144*c*, and second terminals 143*b* and 144*b* of the relay portions 143*c* and 144*c*, respectively.

The unit case 133, as shown in FIG. 12B, includes first terminal holding portions 111*b*, second terminal holding portions 111*c*, and a deformable portion 112. The first terminal holding portions 111*b* hold the first terminals 143*a* and 144*a* of the relay terminals 143 and 144. The second terminal holding portions 111*c* hold the second terminals 143*b* and 144*b* of the relay terminals 143 and 144. The deformable portion 112 is provided between the first terminal holding portions 111*b* and the second terminal holding portions 111*c* and elastically deforms in a direction in which the distance between the first terminal holding portions 111*b* and the second terminal holding portions 111*c* is reduced.

By providing the deformable portion 112 as described above, when the liquid detection unit 111 is fitted to the case body 105, it is possible for the first terminal holding portions 111*b* of the liquid detection unit 111 to be deformed toward the second terminal holding portions 111*c* by the deformable portion 112. Thus, it is possible to perform fitting without a situation that the first terminals 143*a* and 144*a* of the relay terminals 143 and 144, which are held by the first terminal holding portions 111*b*, interfere with the case body 105. In addition, because the deformation is achieved by elastic deformation, the first terminal holding portions 111*b*, after the fitting, return to the original position. Thus, it is possible to reliably connect the first terminals 143*a* and 144*a* of the relay terminals 143 and 144 to the terminals of the case body 105. Accordingly, it is possible to prevent breakage of the relay terminals 143 and 144 when the liquid detection unit 111 is fitted to the case body 105 and thereby it is possible to achieve reliable conduction.

In addition, when the first terminals 143*a* and 144*a* of the relay terminals 143 and 144 are fitted while they are in contact with the case body 105, there is a possibility that poor conduction due to deformation may occur. However, such a problem may be reliably avoided. Moreover, when the liquid detection unit 111 is removed as well, it is possible to easily remove the liquid detection unit 111 by allowing the deformable portion 112 to deform. Furthermore, another advantageous effect is that, when an impact acts on the liquid detection unit 111, owing to the deformable portion 112, it is possible to absorb the impact to the liquid detection unit 111 itself and also possible to make it hard for the impact to be transmitted to the sensor member (piezoelectric element).

The first terminal holding portions 111*b* and the second terminal holding portions 111*c* are not specifically limited. As far as components are able to hold the end portions of the relay terminals 143 and 144, it is applicable. As shown in FIG. 12B, the second terminal holding portions 111*c* each are formed into a boss shape. In order to keep the second terminal 143*b* in contact with the sensor member 132 as shown in FIG. 10, holes 161 are formed in the relay terminals 143 and 144, respectively, as shown in FIG. 10. The boss-shaped second terminal holding portions 111*c* are press-fitted into the holes 161.

Figure 14B:
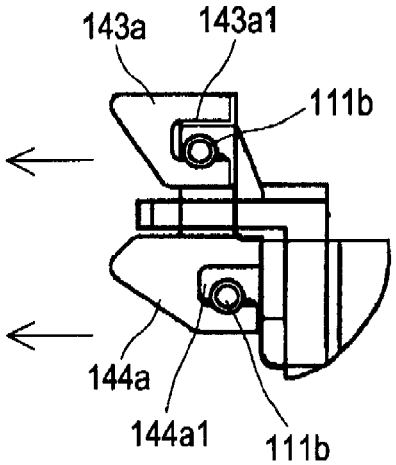
FIG. 14A and FIG. 14B are side views of the liquid detection unit.
Figure 14A:
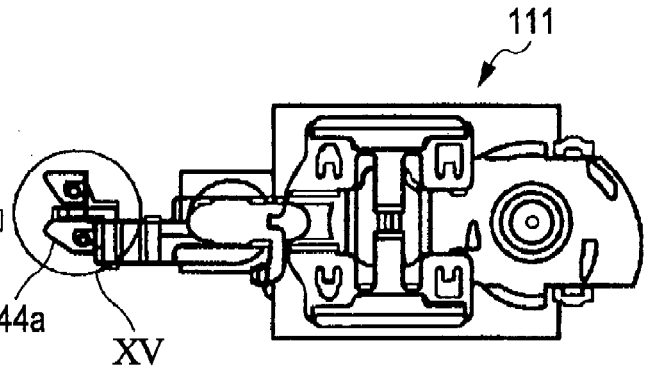

On the other hand, the first terminals 143*a* and 144*a* are desirably held by the first terminal holding portions 111*b* movably. Therefore, the first terminals 143*a* and 144*b* shown in FIG. 14A have oblong hole portions (elongate hole portions) 143*a*1 and 144*a*1, which are formed as shown in FIG. 14B that shows an enlarged view of the XV region of FIG. 14A. The first terminal holding portions 111*b*, which are formed as protruded portions, are inserted into the oblong hole portions 143*a*1 and 144*a*1. Thus, the first terminal holding portions 111*b* movably hold the first terminals 143*a* and 144*a* of the relay terminals 143 and 144.

Furthermore, the first terminals 143*a* and 144*a* of the relay terminals 143 and 144 are urged to protrude in a direction indicated by the arrow shown in FIG. 14B, that is, a direction in which the deformable portion 112 elastically deforms, and are held by the first terminal holding portions 111*b*. The longitudinal directions of the oblong hole portions 143*a*1 and 144*a*1 of the first terminals 143*a* and 144*a* coincide with the direction of the arrow that indicates the direction in which the first terminals 143*a* and 144*a* are urged to protrude in FIG. 14B.

The unit case 133 is formed of a resin material, for example, a polyolefin series material. The polyolefin series material exhibits a high resistance when stress is applied. In addition, according to the polyolefin series material, it is possible to integrally mold the deformable portion 112, which may be elastically deformed, with the unit case body 133*a*.

Figure 11:
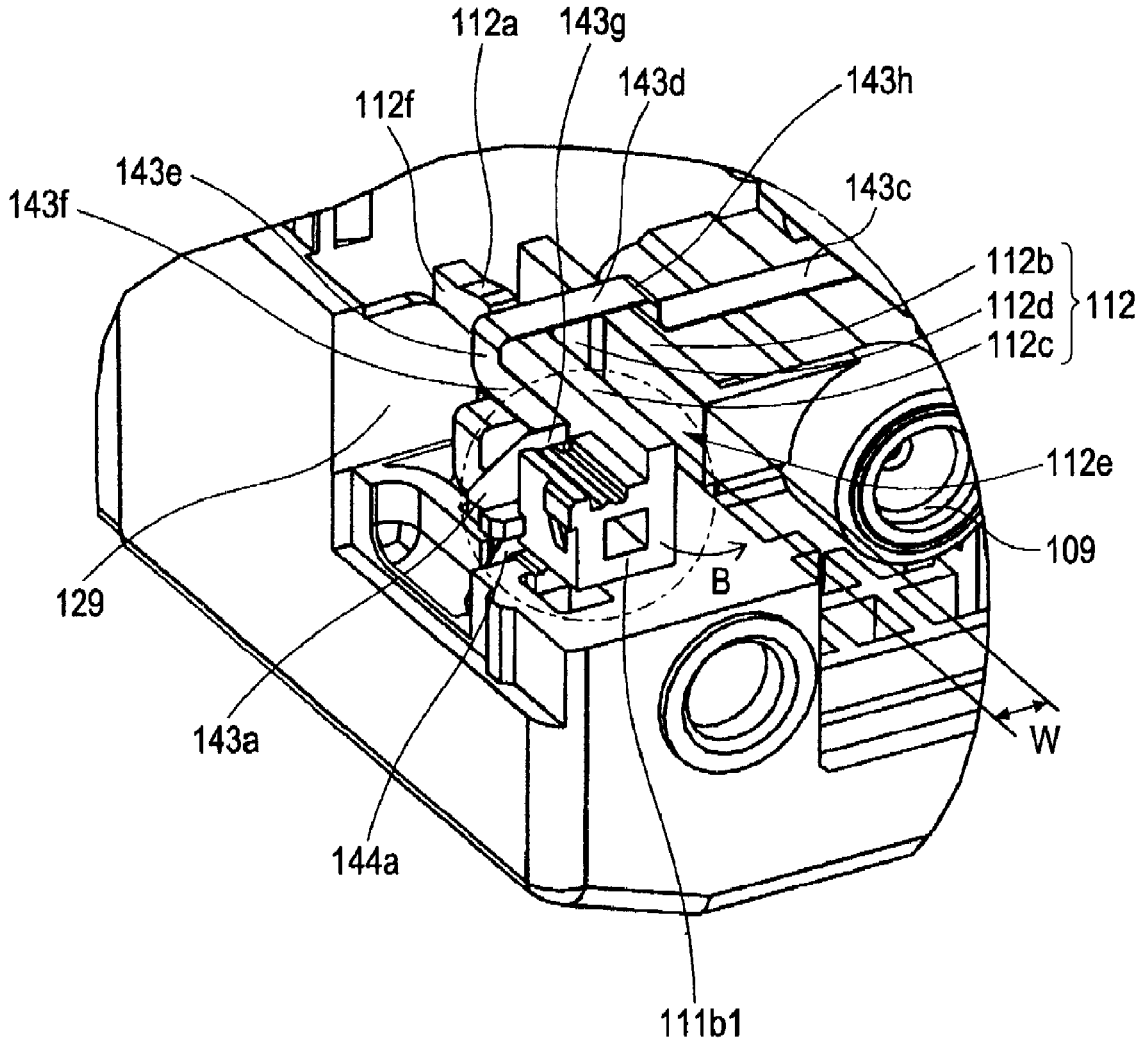
FIG. 11 is a view that illustrates positioning of the liquid detection unit.

The deformable portion 112 of the unit case body 133*a*, as shown in FIG. 6B and FIG. 11, includes a movable body (movable portion) 112*c*, a support body (support portion) 112*b* that supports the movable body 112*c*, and a connecting portion 112*d* that connects the support body 112*b* and the movable body 112*c*. The movable body 112*c* is provided to the side of the first terminal holding portions 111*b* so that it intersects with a direction in which the relay portions 143*c* and 144*c* of the relay terminals 143 and 144 extend. The support portion 112*b* is provided to the side of the second terminal holding portions 111*c* so that it intersects with a direction in which the relay portions 143*c* and 144*c* of the relay terminals 143 and 144 extend, and is provided so as to be spaced apart from the movable body 112*c*. Then, the movable body 112*c*, the support body 112*b* and the connecting portion 112*d* define a slit 112*e*. The deformable portion 112 may elastically deform so as to reduce the groove width W of the slit 112*e*.

As shown in FIG. 12A, the movable body 112*c* has the first terminal holding portions 111*b* to the free end portion side extending from the proximal end connected to the connecting portion 112*d*. Then, a region in which the first terminal holding portions 111*b* are formed is extended to function as an operating portion 111*b*1 that applies an external force to the deformable portion 112.

The relay terminals 143 and 144 each are formed of a metal thin plate. As shown in FIG. 10 and FIG. 11, the relay portions 143*c* and 144*c* respectively include first thin plate portions 143*d* and 144*d* and second thin plate portions 143*f* and 144*f*. The first thin plate portions 143*d* and 144*d* cross over the movable body and the support body. The second thin plate portions 143*f* and 144*f* are respectively bent at flexure portions 143*e* and 144*e* of the end portions of the first thin plate portions 143*d* and 144*d* and extend along the movable body 112*c*. Then, the first terminals 143*a* and 144*a* are respectively bent at flexure portions 143*g* and 144*g* of the end portions of the second thin plate portions 143*f* and 144*f* and are formed to protrude in a direction away from the movable body 112*c*. In addition, the first thin plate portions 143*d* and 144*d* respectively have flexure portions 143*h* and 144*h* that are bent along the support body 112*b*. These flexure portions function as reinforcing portions that enhance the rigidity of the relay terminals 134 and 144.

In FIG. 11, as an external force is applied in a direction indicated by the arrow B by manipulating the operating portion 111*b*1, the deformable portion 112 elastically deforms in a direction in which the movable body 112*c* approaches the support body 112*b*. In this manner, it is possible to reduce the width W of the slit 112*e* between the first terminal holding portions 111*b* and the second terminal holding portions 111*c*. In addition, the deformable portion 112 includes a deformation guiding portion 112*a* (the deformation guiding portion for the relay terminal 144 is not shown in FIG. 11) that, when the deformable portion 112 is deformed, follows the deformation of the movable body 112*c* to guide the first thin plate portions 143*d* and 144*d* of the relay terminals 143 and 144 so as to be deformed toward the first terminal holding portions 111*b*. Because the deformation guiding portion 112*a* is integrally formed with the movable body 112*c*, the deformation guiding portion 112*a* may be applied with force from the sides of the first thin plate portions 143*d* and 144*d*.

The relay terminals 143 and 144, when further described in detail, are fixed to the case body 133*a* of the unit case 133 in a state where the sides of the second terminals 143*b* and 144*b* are in contact with and are electrically connected with the terminals (not shown) of the sensor member 132. In addition, the sides of the first terminals 143*a* and 144*a* of the relay terminals 143 and 144 are electrically connected to the circuit board 131, which is connected to the case body 105, through rotating manipulation when the liquid detection unit 111 is fitted to the case body 105.

Method of Manufacturing Liquid Container

The ink cartridge 100 of the present embodiment is assembled in the following procedure, including the above electrical connection.

First, as shown in FIG. 13A, the liquid detection unit 111 is fitted to the fitting portion 123 (see FIG. 9B) of the case body 105 in such an orientation that the liquid detection unit 111 is uprighted. After that, the ink pack 107 is set in the case body 105. At this time, the connection needle 111*a* (see FIG. 12B) of the liquid detection unit 111 breaks through the sealing film 108 and is connected to the ink delivery member 107*a* of the ink pack 107. In addition, the case fitting portion 135 (see FIG. 12B) of the liquid detection unit 111 is rotatably engaged with the protruded walls 123*a* and 123*b* (see FIG. 9B) that are provided on the partition wall 105*a* of the case body 105.

Subsequently, the fitted liquid detection unit 111 is rotated in a direction indicated by the arrow shown in FIG. 13A. To the terminal position side in the rotating direction, as shown in FIG. 11, the liquid detection unit 111 contacts a positioning portion 129 of the case body 105.

Here, as the liquid detection unit 111 is simply rotated by manipulation, the first terminals 143*a* and 144*a* of the relay terminals 143 and 144 interfere with the upper end of the side wall 105*d* of the detection unit accommodating portion shown in FIG. 13B.

Then, before the first terminals 143*a* and 144*a* interfere with the side wall 105*d*, the operating portion 111*b*1 shown in FIG. 11 is pushed in the arrow B direction by manipulation. In this manner, it is possible to reduce the groove width W of the slit 112*e* by elastically deforming the deformable portion 112.

At this time, when the deformable portion 112 is deformed, the first thin plate portions 143*d* and 144*d* of the relay terminals 143 and 144 are guided by the deformation guiding portion 112*a*, following the deformation of the movable body 112*c*, and, therefore, it is possible to reliably make the first terminals 143*a* and 144*a* follow the movable body 112*c*.

Thus, the first terminals 143*a* and 144*a* of the relay terminals 143 and 144 do not interfere with the upper end of the side wall 105*d* of the detection unit accommodating portion shown in FIG. 13B, so that the liquid detection unit 111 may be further rotated to reach the above described rotating terminal position.

At the rotating terminal position, as shown in FIG. 11, the liquid detection unit 111 contacts the positioning portion 129 of the case body 105. Here, the movable body 112*c*, as shown in FIG. 11, has the operating portion 111*b*1 at one free end portion that extends from the proximal end connected to the connecting portion 112*d* and, on the other hand, has a positioned portion 112*f* that extends from the proximal end toward the other free end portion. When the positioned portion 112*f* contacts the positioning portion 129, deformation such that the groove width W of the slit 112*e* is reduced does not occur in the deformable portion 112. This is because, in order to reduce the groove width W of the slit 112*e*, the groove width of the positioned portion 112*f* side needs to be increased; however, the positioning portion 129 blocks this increase. Thus, deformation of the deformable portion 112 is prevented at the rotating terminal position.

Figure 15:
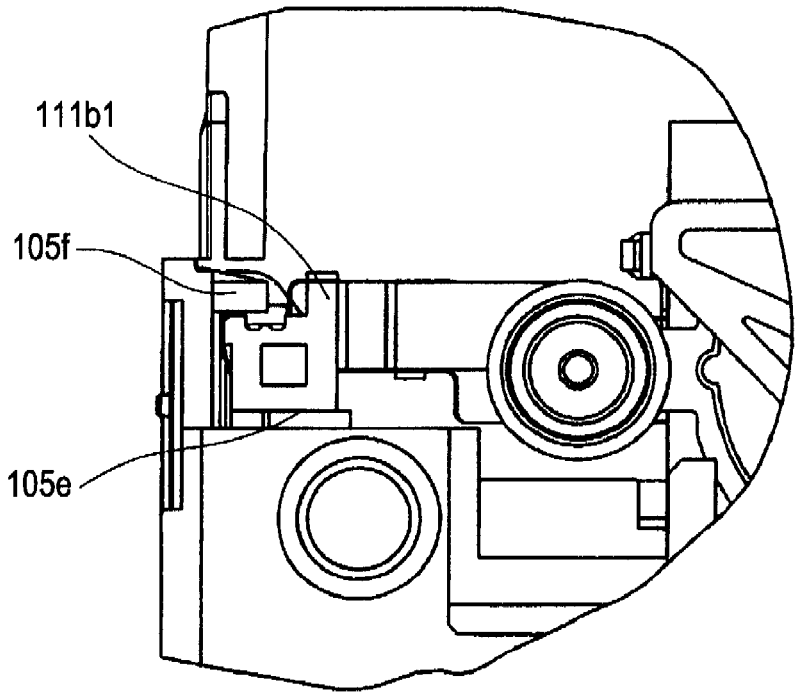
FIG. 15 is a view that illustrates positioning of the liquid detection unit.

In addition, at the rotating terminal position, it is also restricted that the liquid detection unit 111 is rotated toward the original position. This is because, as shown in FIG. 15, the operating portion 111*b*1 is held between a contact face 105*e*, provided at the bottom face of the case body 105, and a rotation restriction rib 105*f* formed above the contact face 105*e*. The rotating terminal position is defined at this position, and the liquid detection unit 111 is prevented from being rotated to return to the original position unless the operating portion 111*b*1 is manipulated. Note that the operating portion 111*b*1 is manipulated while rotating the liquid detection unit 111 so that the liquid detection unit 111 does not interfere with the rotation restriction rib 105*f*.

When an external force applied to the operating portion 111*b*1 is released at the rotating terminal position, the first terminals 143*a* and 144*a* return to the front position together with the movable body 112*c* and are electrically connected to the fixed contacts 131*d* of the circuit board 131, as shown in FIG. 13B. At this time, the first terminals 143*a* and 144*a* that have the oblong hole portions 143*a*1 and 144*a*1, through which the first terminal holding portions 111*b*, which serve as protruding portions, are inserted as shown in FIG. 14B, are urged to protrude forward in a direction indicated by the arrow in FIG. 14B. Thus, even at the rotating terminal position at which deformation of the deformable portion 112 is blocked, it is possible to elastically press the first terminals 143*a* and 144*a* so as to contact the circuit board 131. This ensures electrical connection that is resistant to vibration or the like.

Note that, when the ink cartridge 100 is attached to the cartridge attachment portion of the recording apparatus, the ink supply needle provided at the cartridge attachment portion breaks through the sealing film 157 and is inserted into the liquid delivery member 109. Thus, ink may be supplied from the ink cartridge 100 to the recording head.

Fitting Structure of Circuit Board

Figure 18:
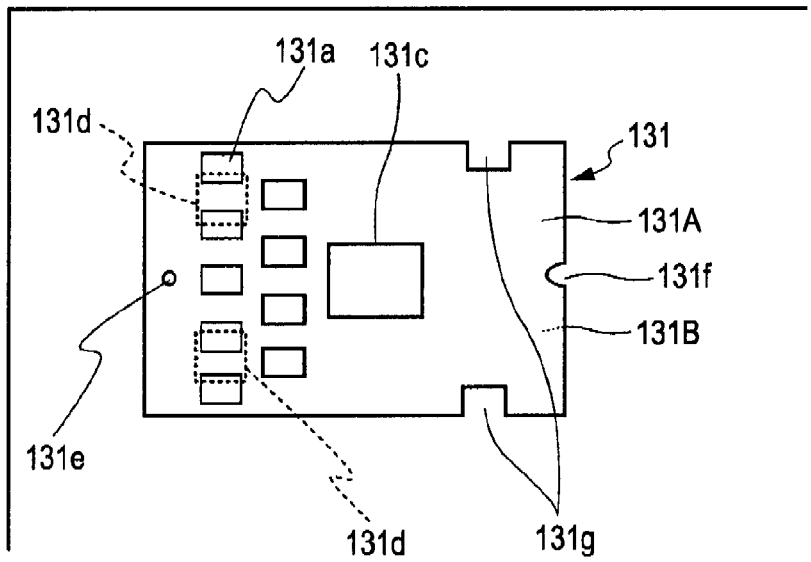
FIG. 18 is a plan view of the circuit board.

FIG. 18 is a plan-view of the circuit board 131 shown in FIG. 8 and FIG. 9A. FIG. 18 is a view of the circuit board 131 when viewed from the front face side. The plurality of contacts 131*a*, which are connected to the connecting terminals (connector) of the cartridge attachment portion side, are formed on the front face 131A. In addition, as shown by the broken line in FIG. 18, the memory element 131*c* and the fixed contacts 131*d* are formed on the rear face 131B of the circuit board 131. The memory element 131*c* records information of the residual amount of ink, the usage history of cartridge, or the like. The fixed contacts 131*d* are connected through the relay terminals 143 and 144 to the sensor member 132.

In addition, for example, the hole 131*e* is formed at the one side in the longitudinal direction of the circuit board 131, and the slit 131*f* is formed at the other side thereof. Note that the circuit board 131 is formed with a cutout portion (in a broad sense, bending deformable portion) 131*g*; however, the description thereof will be described later.

Figure 19:
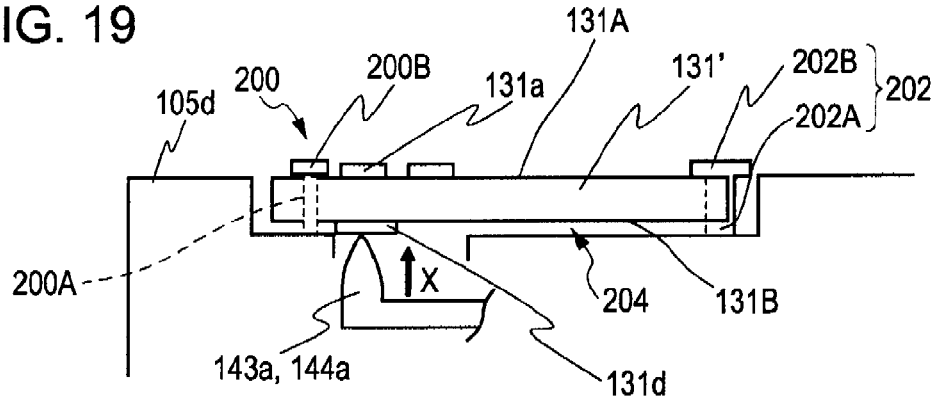
FIG. 19 is a view that illustrates a problem when the circuit board that has no cutout portion shown in FIG. 18 is mounted on a case body of the circuit board.

FIG. 19 is a view that shows a comparative embodiment in which a circuit board 131', which is obtained by excluding the cutout portion 131*g* from the circuit board 131 shown in FIG. 18, is fitted to the side wall 105*d* of the case body 105. As shown in FIG. 19, the circuit board 131' is fitted to the side wall 105*d* of the case body 105 in such an orientation that the front face 131A is exposed and the rear face 131B faces the inside of the case body 105.

The side wall 105*d* includes a first engaging portion 200 and a second engaging portion 202 that engage the circuit board 131' at both sides intervening the fixed contacts 131*d* in one side direction of the circuit board 131'. The first engaging portion 200 is, for example, a shaft 200A that is inserted through the hole 131*e* of the circuit board 131', and the upper end of the shaft 200A that protrudes from the hole 131*e* is melted to form a thermally caulked portion 200B. On the other hand, the second engaging portion 202 is, for example, a shaft 202A that is arranged in the slit 131*f* of the circuit board 131', and the upper end of the shaft 202A that protrudes from the slit 131*f* is melted to form a thermally caulked portion 202B.

FIG. 19 is a view that shows a state in which the thermally caulked portions 200B and 202B are not sufficiently formed. The inconvenience in this state will be described as follows. As the liquid detection unit 111 is attached as described above, the first terminals 143*a* and 144*a* are pressed to contact the fixed contacts 131*d* of the rear face 131B of the circuit board 131' in a direction indicated by the arrow X. At this time, in FIG. 19, because of the pressing force of the first terminals 143*a* and 144*a*, the rear face 131B of the circuit board 131' leaves the opposite face of the side wall 105*d* to thereby form a gap 204. That is, because the thermally caulked portion 200B is not formed into a sufficient size, the gap 204 is formed.

When the thermally caulked portion 200B cannot be formed into a sufficient size, it means that the thermally caulked portion 200B does not have a sufficient strength. As the strength of the thermally caulked portion 200B is weak, there is a possibility that the circuit board 131' is separated from the first engaging portion 200 by the pressing force of the first terminals 143*a* and 144*a*.

Figure 20:
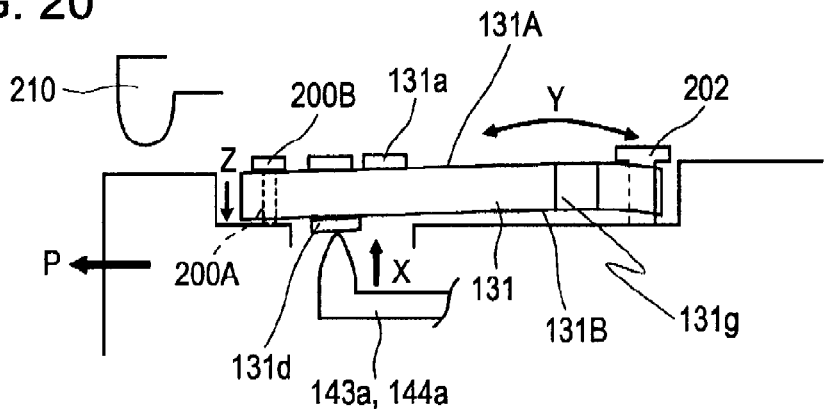
FIG. 20 is a view that illustrates an operation when the circuit board shown in FIG. 18 is mounted on a case body.

FIG. 20 is a view that shows a state in which the circuit board 131 that has the cutout portion 131*g* shown in FIG. 18 is attached, and is a view that illustrates the present embodiment in which, even with the thermally caulked portion 200B that is insufficiently thermally caulked as shown in FIG. 18, it is possible to prevent the circuit board 131 from falling off.

As shown in FIG. 20, as the pressing force is applied in the arrow X direction by the first terminals 143*a* and 144*a*, bending occurs in a Y direction shown in the drawing at the cutout portion 131*g* of which the bending resistance strength is weak within the circuit board 131. The bending deformation increases to absorb the pressing force from the first terminals 143*a* and 144*a*, so that it is possible to reduce a force that the thermally caulked portion 200B (and the thermally caulked portion 202B) receives. Thus, it is possible to prevent an accident that the circuit board 131 falls off from the thermally caulked portion 200B that is thermally insufficiently caulked.

The above function requires that the circuit board 131 has the cutout portion 131*g* that functions as the bending deformable portion at a position between the fixed contacts 131*d* and the end portion of the second engaging portion 202 side in the one side direction of the circuit board 131. In addition, in FIG. 18, two portions, that is, the hole 131*e* and the slit 131*g*, are held by the first engaging portion 200 and the second engaging portion 202, respectively; however, the number of engaging portions having a thermally caulked portion may be increased in conformity to pressure applied from the first terminals 143*a* and 144*a*.

Another advantageous effect obtained with the structure shown in FIG. 20 is that, when the ink cartridge 100 is attached to the cartridge attachment portion of the recording apparatus, it is possible to improve the relationship between an apparatus side connector 210 and the circuit board 131. As shown in FIG. 20, when the circuit board 131 undergoes bending deformation as shown in the drawing, the circuit board 131 deforms to decline toward both ends with a peak at the bending deformable portion (cutout portion) 131*g*. Therefore, in comparison with the state shown in FIG. 19 (because the cutout portion 131*g* is not formed, the circuit board 131 is hard to deform), in the longitudinal direction of the circuit board 131, the circuit board 131 declines in a direction indicated by the arrow Z at a position of the end portion to the side opposite the thermally caulked portion 200B than the position of the cutout portion 131*g* and the circuit board 131 is inclined between the position of the cutout portion 131*g* and the end portion of the board. When the ink cartridge 100 is attached to the cartridge attachment portion of the recording apparatus, the ink cartridge is moved in a direction indicated by the arrow P. Because of the movement, the apparatus side connector 210 contacts the contacts 131*a* formed on the front face 131A of the circuit board 131. In the above process, the circuit board 131 contacts the apparatus side connector 210 at an angle, and then the circuit board 131 is attached while it slide contacts on the connector 210. At the initial stage, when the insertion distal end side of the circuit board 131 initially contacts the apparatus side connector 210, the insertion distal end side of the inclined circuit board 131 may be guided so that the apparatus side connector 210 slide contacts on the circuit board 131. Thus, at the corner portion of the insertion distal end side of the circuit board 131, there is no possibility that a crack occurs because of a collision with the apparatus side connector 210 or the circuit board 131 itself falls off from the thermally caulked portion 200B.

Method of Disassembling Liquid Container

In a method of disassembling the ink cartridge 100, particularly, when the liquid detection unit 111 is removed from the case body 105, the deformable portion 112 is deformed by manipulating the operating portion 111*b*1 to thereby reduce the groove width W of the slit 112*e* shown in FIG. 11. After that, the liquid detection unit 111 is rotated while the operating portion 111*b*1 is manipulated. In this manner, the liquid detection unit 111 may be rotated to return to a state shown in FIG. 13A so that the operating portion 111*b*1 does not interfere with the upper end of the side wall 105*d* shown in FIG. 13B and the rotation restriction rib 105*f* shown in FIG. 15.

Thus, because the liquid detection unit 111 may be removed without breakage thereof, it is possible to reuse the liquid detection unit 111.

Note that the present embodiment is described in detail; however, a person skilled in the art will easily understand that many alternative embodiments that substantively do not depart from the scope of the invention and the advantageous effects obtained from the invention. Accordingly, the invention also encompasses all of such alternative embodiments.

For example, in the specification or in the drawing, a word that is described at least once together with a broader or a synonymous but different word may be replaced by the different word at any portion in the specification or in the drawing.

Figure 16A:
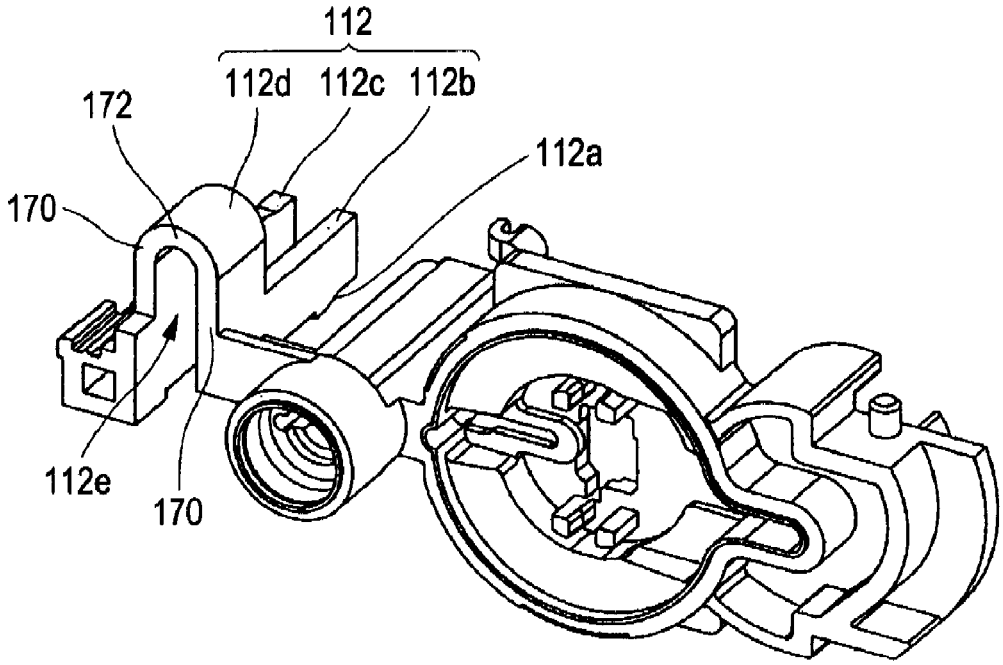
FIG. 16A and FIG. 16B are perspective views of a unit case.
Figure 16B:
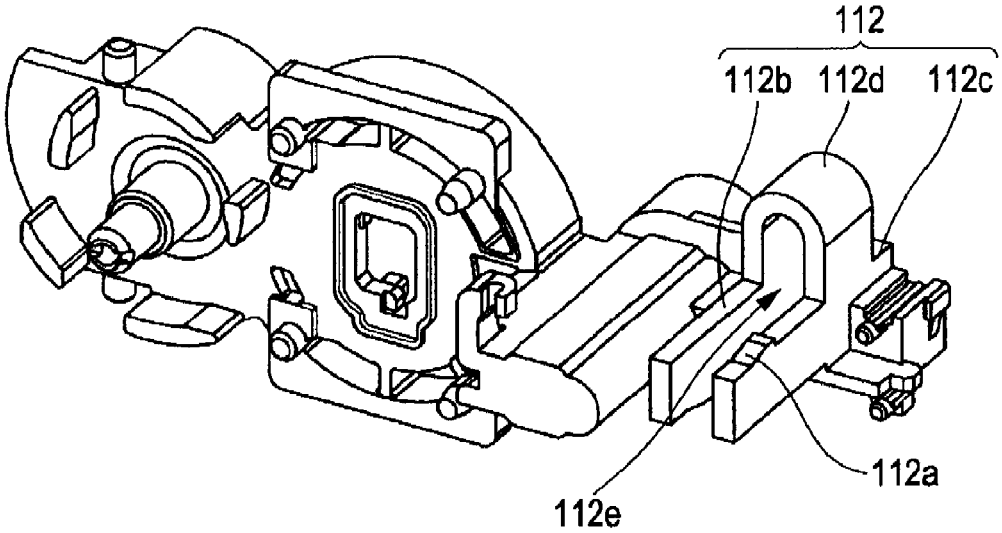

For example, the deformable portion 112 may be modified as follows. In a first alternative embodiment, as shown in FIG. 16A and FIG. 16B, the connecting portion 112*d* that connects the movable body 112*c* and the support body 112*b* may be formed in a U shape. That is, the connecting portion 112*d* has two upright portions 170 and a link portion 172. The upright portions 170 extend further upward than the proximal ends that are connected to the movable body 112*c* and the support body 112*b*. The link portion 172 connects the upper end portions of the two upright portions 170. The two upright portions 170 function as a holding portion for applying an external force to deform the deformable portion 112. That is, by holding the holding portion 170, it is possible to deform the deformable portion 112 so as to reduce the groove width of the slit 112*e* between the two upright portions 170.

Figure 17A:
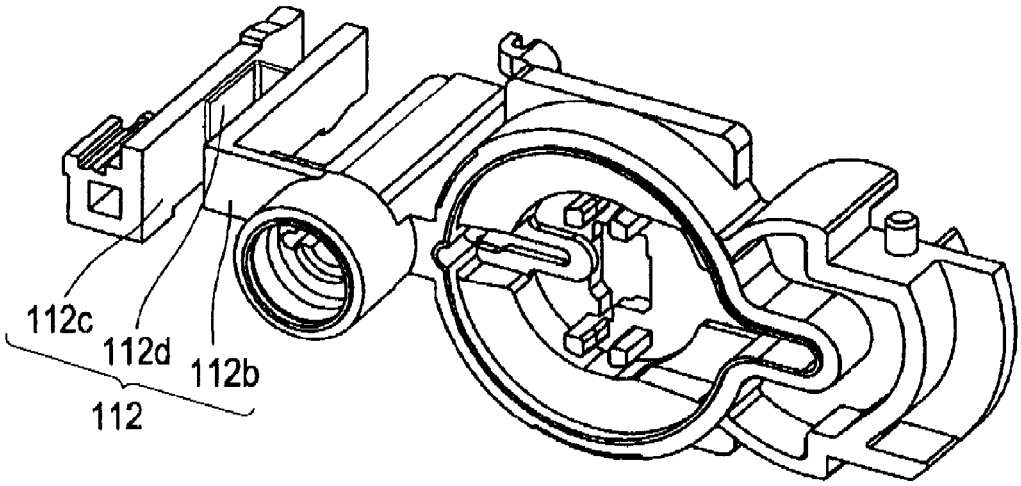
FIG. 17A and FIG. 17B are perspective views of the unit case.
Figure 17B:
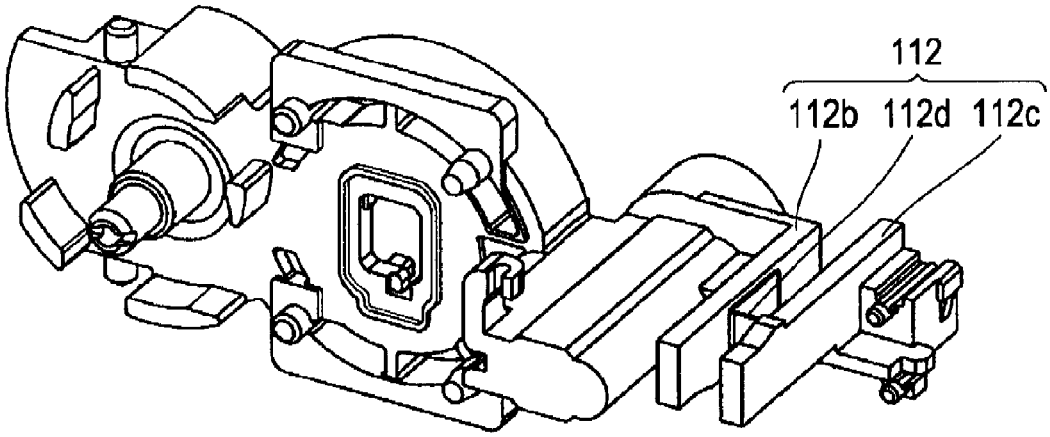

In a second alternative embodiment, as shown in FIG. 17A and FIG. 17B, the connecting portion 112*d* that connects the movable body 112*c* and the support body 112*b* is formed of an elastic body (for example, spring) that is independent of the case body 133*a*. In this case as well, it is possible to deform the deformable portion 112 so as to reduce the groove width of the slit 112*e*.

In the above embodiment, the fluid ejecting apparatus may be embodied as a so-called full-line type (line head type) printer in which the recording head 19 is formed into an overall shape that corresponds to the length in the width direction (right-left direction) of a recording sheet of paper (not shown) in a direction that intersects with a transport direction (front-rear direction) of the recording sheet of paper (not shown).

In the above embodiment, the liquid ejecting apparatus is embodied as the ink jet printer 11; however, it is not limited. The aspects of the invention may be embodied as a fluid ejecting apparatus that ejects or discharges another liquid (including liquid body formed of particles of a functional material being dispersed or mixed in a liquid and a fluidized body such as a gel) other than ink. For example, the aspects of the invention may be embodied as a liquid ejecting apparatus, which ejects a liquid body that contains materials such as electrode materials or color materials (pixel materials), used for manufacturing a liquid crystal display, an electroluminescence (EL) display and a field emission display, or the like, through dispersion or solution, a liquid ejecting apparatus, which ejects a bio-organic material, used for manufacturing a bio-chip, or a liquid ejecting apparatus, which ejects a liquid as a sample, used as a precision pipette. Furthermore, the aspects of the invention may also be embodied as a liquid ejecting apparatus that ejects a lubricating oil pinpoint to a precision machine, such as a clock, a watch or a camera, a liquid ejecting apparatus that ejects a transparent resin droplet of ultraviolet curing resin, or the like, for forming a microscopic semispherical lens (optical lens), or the like, used for an optical communication element, or the like, on a substrate, a liquid ejecting apparatus that ejects an etchant, such as acid or alkali, for performing etching on a substrate, or the like, or a fluidized body ejecting apparatus that ejects a fluidized body, such as a gel (for example, physical gel). Then, the aspects of the invention may be applied to any one of these liquid ejecting apparatuses. Note that, in the specification, the word "liquid" includes an inorganic solvent, an organic solvent, a solution, a liquid resin, a liquid metal (metal melt), a liquid body, a fluidized body, and the like.

What is claimed is:

1. A liquid detection unit comprising:

a unit case;

a sensor that is held by the unit case; and a relay terminal that has a relay portion and first and second terminals, wherein the first and second terminals are provided on both ends of the relay portion, wherein the second terminal is connected to the sensor, wherein the unit case includes:

a first terminal holding portion that holds the first terminal of the relay terminal;

a second terminal holding portion that holds the second terminal of the relay terminal; and a deformable portion that is provided between the first terminal holding portion and the second terminal holding portion, and that elastically deforms in a direction in which a distance between the first terminal holding portion and the second terminal holding portion is reduced, wherein the deformable portion includes a slit, and wherein the deformation portion elastically deforms so as to reduce the groove width of the slit, and wherein the deformable portion includes:

a movable portion that is provided on a side of the first terminal holding portion in such an orientation that the movable portion intersects with a direction in which the relay portion of the relay terminal extends;

a support portion that is provided on a side of the second terminal holding portion in such an orientation that the support portion intersects with the direction in which the relay portion of the relay terminal extends, and that is provided so as to be spaced apart from the movable portion; and a connecting portion that connects the movable portion and the support portion, and wherein the slit is defined by the movable portion, the support portion and the connecting portion.

2. The liquid detection unit according to claim 1, wherein the movable portion has a proximal end that is connected to the connecting portion and a free end portion that extends from the proximal end, and wherein the first terminal holding portion is provided at the free end portion.

3. The liquid detection unit according to claim 2, further comprising:

an operating portion that is provided at the free end portion of the movable portion for applying an external force to deform the deformable portion.

4. The liquid detection unit according to claim 1, wherein the connecting portion includes:

two upright portions that respectively extend upward from proximal ends thereof, the proximal ends being connected to the movable portion and the support portion; and a link portion that connects upper end portions of the two upright portions, and wherein the two upright portions function as a holding portion for applying an external force to deform the deformable portion.

5. The liquid detection unit according to claim 1, wherein the connecting portion is formed of an elastic member that is independent of the unit case.

6. The liquid detection unit according to claim 1, wherein the relay terminal is formed of a metal thin plate, wherein the relay portion includes:

a first thin plate portion that crosses over the movable portion and the support portion; and a second thin plate portion that is bent at an end portion of the first thin plate portion and that extends along the movable portion, and wherein the first terminal is bent at an end portion of the second thin plate portion and is formed to protrude in a direction away from the movable portion.

7. The liquid detection unit according to claim 6, wherein the deformable portion includes a deformation guiding portion that deforms to guide the first thin plate portion by following deformation of the deformable portion.

8. The liquid detection unit according to claim 6, wherein the first thin plate portion includes a reinforcing portion that is bent along the support portion to be reinforced.

9. The liquid detection unit according to claim 1, wherein the first terminal holding portion movably holds the first terminal of the relay terminal, and wherein the first terminal of the relay terminal is urged to protrude in a direction in which the deformable portion elastically deforms and is held by the first terminal holding portion.

10. The liquid detection unit according to claim 9, wherein the first terminal includes an elongate hole having a longitudinal direction in a direction in which the first terminal is urged to protrude, and wherein the first terminal holding portion of the unit case includes a protruding portion that is inserted in the elongate hole.

11. A liquid container comprising:

a liquid containing package that contains liquid;

a case that has a liquid container portion that accommodates the liquid containing package and that is provided with a fixed contact; and the liquid detection unit according to claim 1, wherein the liquid detection unit is connected through an attachment portion, which is provided in the case of the liquid container, to a liquid delivery portion of the liquid containing package, wherein the relay terminal of the liquid detection unit is configured so that the first terminal is connected to the fixed contact.

12. The liquid container according to claim 11, wherein the liquid detection unit is fitted by rotating about the attachment portion.

13. The liquid container according to claim 10, wherein the case of the liquid container includes:

a detection unit accommodating portion that accommodates the liquid detection unit;

a partition wall that defines the liquid container portion and the detection unit accommodating portion and that has the attachment portion; and a side wall that defines the detection unit accommodating portion together with the partition wall and that holds a circuit board, wherein the fixed contact is provided in the circuit board.

14. The liquid container according to claim 13, wherein the side wall includes a board holding portion that holds the circuit board in such an orientation that the circuit board exposes a front face thereof, wherein the fixed contact, which the first terminal contacts, is formed on a rear face of the circuit board, wherein the board holding portion includes first and second engaging portions that engage the circuit board at both sides intervening the fixed contact in one side direction of the circuit board, wherein the first and second engaging portions engage the circuit board by means of thermal caulking, wherein the circuit board includes a bending deformable portion that is formed between the fixed contact and the second engaging portion in the one side direction.

15. The liquid container according to claim 14, wherein the bending deformable portion is formed of a cutout portion that is formed in the circuit board.

16. The liquid container according to claim 11, wherein the case of the liquid container includes a positioning portion that positions the liquid detection unit in a state where the first terminal of the liquid detection unit is connected to the fixed contact.

17. The liquid container according to claim 16, wherein the positioning portion holds the deformable portion so as not to deform after the liquid detection unit has been attached.

18. A liquid container comprising:

a liquid containing package that contains liquid;

a case that has a liquid container portion that accommodates the liquid containing package, and that is provided with a fixed contact; and the liquid detection unit according to claim 1, wherein the liquid detection unit is connected through an attachment portion, which is provided in the case of the liquid container, to a liquid delivery portion of the liquid containing package, wherein the case of the liquid container includes a positioning portion that positions the liquid detection unit in a state where the first terminal of the liquid detection unit is connected to the fixed contact, wherein the liquid detection unit includes a positioned portion that is formed by extending the movable portion beyond the connecting portion, and wherein the positioning portion is in contact with the positioned portion.

19. The liquid detection unit according to claim 1, wherein the first terminal holding portion, the first terminal holding portion and the deformable portion are formed on the unit case.

* * * * *